US011824305B2

(12) United States Patent
Yi et al.

(10) Patent No.: US 11,824,305 B2
(45) Date of Patent: Nov. 21, 2023

(54) ROBUST AND RELIABLE HIGH SPEED ELECTRICAL CONNECTOR ASSEMBLY

(71) Applicant: Amphenol Commercial Products (Chengdu) Co., Ltd., Chengdu (CN)

(72) Inventors: Luyun Yi, Chengdu (CN); Jing Wang, Chengdu (CN)

(73) Assignee: Amphenol Commercial Products (Chengdu) Co., Ltd., Chengdu (CN)

( * ) Notice: Subject to any disclaimer, the term of this patent is extended or adjusted under 35 U.S.C. 154(b) by 97 days.

(21) Appl. No.: 17/402,280

(22) Filed: Aug. 13, 2021

(65) Prior Publication Data

US 2022/0085548 A1 Mar. 17, 2022

(30) Foreign Application Priority Data

Sep. 11, 2020 (CN) ..... 202010952023.8
Sep. 11, 2020 (CN) ..... 202021981365.4

(51) Int. Cl.
*H01R 13/627* (2006.01)
*H01R 12/73* (2011.01)
*H01R 12/70* (2011.01)

(52) U.S. Cl.
CPC ..... *H01R 13/6271* (2013.01); *H01R 12/7047* (2013.01); *H01R 12/7076* (2013.01); *H01R 12/73* (2013.01)

(58) Field of Classification Search
CPC ..... H01R 13/6271; H01R 12/7047; H01R 12/7076; H01R 12/73
(Continued)

(56) References Cited

U.S. PATENT DOCUMENTS 6,168,464 B1 * 1/2001 Choy ..... H01R 12/7029 439/567
6,551,116 B1 * 4/2003 Liu ..... H01R 12/712 439/79
(Continued)

FOREIGN PATENT DOCUMENTS

CN 201000953 Y * 1/2008
CN 201112652 Y * 9/2008
(Continued)

OTHER PUBLICATIONS

International Search Report and Written Opinion dated Dec. 9, 2021 in connection with International Application No. PCT/CN2021/117385.

*Primary Examiner* — Peter G Leigh
(74) *Attorney, Agent, or Firm* — Wolf, Greenfield & Sacks, P.C.

(57) ABSTRACT

An electrical connector assembly including an electrical connector and a shell partially surrounding an insulative housing of the electrical connector. The insulative housing has a mating face with a socket formed therein. The socket can receive a first printed circuit board of a first electronic device such as a solid state drive (SSD). The shell includes a die cast body that has an outer shell and an inner shell separated by a slot. The inner shell includes an opening and the insulative housing is disposed within the opening. The slot receives an edge of a housing of the first electronic device. The shell includes features attached to a second electronic device such as a second printed circuit board (e.g., a motherboard). The shell includes a latching mechanism movably mounted to the body. Such configuration enables a robust and reliable electrical connection between the first electronic system and the second electronic system.

20 Claims, 22 Drawing Sheets

(58) Field of Classification Search
USPC ..... 439/62
See application file for complete search history.

(56) References Cited

U.S. PATENT DOCUMENTS

| | | | | |
|---|---|---|---|---|
| 6,971,884 | B2 * | 12/2005 | Zhao | H01R 12/721 439/62 |
| 7,147,498 | B1 | 12/2006 | Gillespie et al. | |
| 7,431,605 | B2 * | 10/2008 | Dieterle | H01R 13/6272 439/948 |
| 7,537,465 | B2 * | 5/2009 | Fang | H01R 12/716 439/247 |
| 7,789,681 | B2 * | 9/2010 | Guan | H01R 12/7005 439/157 |
| 7,828,560 | B2 * | 11/2010 | Wu | H01R 12/721 439/79 |
| 7,938,657 | B2 * | 5/2011 | Tang | H01R 12/721 439/157 |
| 7,972,171 | B2 * | 7/2011 | Teh | H01R 12/721 439/570 |
| 7,988,480 | B2 * | 8/2011 | Yao | H01R 12/7011 439/329 |
| 8,002,563 | B2 * | 8/2011 | Li | H01R 12/7005 439/157 |
| 8,070,499 | B2 * | 12/2011 | Guan | H01R 12/7029 439/155 |
| 8,235,738 | B2 * | 8/2012 | Li | H01R 13/639 439/347 |
| 8,403,683 | B2 * | 3/2013 | Yao | H01R 13/506 439/79 |
| 8,444,424 | B2 * | 5/2013 | Shen | H01R 12/721 439/153 |
| 8,535,077 | B2 * | 9/2013 | Shen | H01R 13/6275 439/328 |
| 8,794,985 | B2 * | 8/2014 | Li | H01R 12/7005 439/157 |
| 8,814,580 | B2 * | 8/2014 | Shen | H01R 12/7029 439/157 |
| 8,900,001 | B2 * | 12/2014 | Li | H01R 12/7005 439/157 |
| 9,022,809 | B2 * | 5/2015 | Tang | H01R 12/721 439/637 |
| 9,240,640 | B2 * | 1/2016 | Shen | H01R 12/7029 |
| 10,193,253 | B2 * | 1/2019 | Li | H01R 12/83 |
| 10,205,256 | B2 | 2/2019 | Wu et al. | |
| 10,224,653 | B2 * | 3/2019 | Niu | H01R 12/721 |
| 10,263,372 | B2 * | 4/2019 | Yao | H01R 24/60 |
| 10,333,243 | B2 * | 6/2019 | Tang | H01R 12/7011 |
| 10,490,920 | B2 * | 11/2019 | Manickam | H01R 13/648 |
| 10,535,957 | B2 * | 1/2020 | Zhao | H01R 13/6585 |
| 10,644,457 | B2 | 5/2020 | Chen | |
| 2005/0153585 | A1 * | 7/2005 | Bu | H01R 12/721 439/79 |
| 2009/0298305 | A1 * | 12/2009 | Wu | H01R 12/712 439/62 |
| 2010/0167558 | A1 * | 7/2010 | Guan | H01R 12/707 439/65 |
| 2015/0003002 | A1 * | 1/2015 | Yang | G06F 1/185 361/679.32 |
| 2018/0241148 | A1 | 8/2018 | Tang et al. | |

FOREIGN PATENT DOCUMENTS

| | | | | |
|---|---|---|---|---|
| CN | 203260816 | U * | 10/2013 | |
| CN | 205335558 | U * | 6/2016 | H01R 12/53 |
| CN | 205752742 | U * | 11/2016 | |
| CN | 106207633 | A * | 12/2016 | |
| CN | 210120271 | U | 2/2020 | |
| CN | 210326224 | U | 4/2020 | |
| CN | 212725805 | U | 3/2021 | |
| JP | 2013122757 | A * | 6/2013 | G06F 1/185 |

* cited by examiner

ROBUST AND RELIABLE HIGH SPEED ELECTRICAL CONNECTOR ASSEMBLY

RELATED APPLICATIONS

This application claims priority to and the benefit of Chinese Patent Application Serial Nos. 202021981365.4 and 202010952023.8, both filed on Sep. 11, 2020. The entire contents of these applications are incorporated herein by reference in their entirety.

FIELD

This application relates to interconnection systems for electronic devices, such as those including electrical connectors, used to interconnect electronic assemblies.

BACKGROUND

Electrical connectors may be used to provide an electrical connection between electronic systems, such as printed circuit boards (PCBs). One typical electrical connector is a card edge connector that may be mounted onto a first electronic system, such as a motherboard, so that tail portions of terminals of the card edge connector are electrically connected to conductive portions of the first electronic system by, for example, soldering. The card edge connector may also act as a female connector for interfacing directly with conductive portions on or near the edge of the PCB of a second electronic system, such as a solid state drive (SSD), such that the conductive portions of the second electronic system is in contact with the contact portions of the corresponding terminals of the electrical connector. In this case, the PCB itself acts as a male connector for interfacing with the card edge connector, without the need for a separate male connector. In this way, the conductive portions of the second electronic system may be electrically connected to the corresponding conductive portions of the first electronic system via the terminals of the card edge connector, thereby establishing an electrical connection between the first electronic system and the second electronic system.

BRIEF SUMMARY

Aspects of the present disclosure relate to robust and reliable high speed electrical connector assemblies.

Some embodiments relate to a shell for an electrical connector. The electrical connector may include an insulative housing and a plurality of terminals disposed in the insulative housing. Each of the plurality of terminals may include a contact portion and a tail portion, the tail portion protruding from a first mounting face of the insulative housing and capable of being mounted to a first circuit board. The shell may include a fixing mechanism for being fixed to the first circuit board. The shell may include a body configured to at least partially surround the insulative housing.

In some embodiments, the shell may include a locking assembly movably mounted to the body.

In some embodiments, the locking assembly may be configured for locking a second electronic system mounted to the electrical connector in place.

In some embodiments, the locking assembly may include a pivot mounted to the body; a locking member pivotally mounted to the pivot and capable of pivoting about the pivot in a first direction and a second direction opposite to the first direction; and a bias member arranged to act on the locking member such that the locking member tends to pivot towards a locked position in the first direction.

In some embodiments, the locking member may include an actuation portion. The actuation portion, when actuated, may cause the locking member to pivot towards a released position in the second direction against the action of the bias member.

In some embodiments, the bias member may be a torsion spring, and the torsion spring may be disposed around the pivot.

Some embodiments relate to an electrical connector. The electrical connector may include an insulative housing; a plurality of terminals supported by the insulative housing, and a shell. Each of the plurality of terminals may include a contact portion and a tail portion. The tail portion may protrude from a first mounting face of the insulative housing and may be capable of being mounted to a first circuit board. The shell may include a body partially surrounding the insulative housing, and a locking assembly movably mounted to the body.

In some embodiments, the locking assembly may include a rod attached to the shell; a member comprising a latching feature; and a spring mounted around the rod and configured to bias the member to rotate about an axis of rotation such that the latching feature is biased into a latching position.

In some embodiments, the member of the locking member may include a pivot plate and the latching feature may extend from the pivot plate.

In some embodiments, the connector may include a position assurance device configured to: (a) fit between the latching mechanism and the shell when the latching mechanism is in a latched position; (b) block movement of the latching mechanism when fully inserted between the latching mechanism and the shell; and (c) abut the latching mechanism when the latching mechanism is out of the latched position so as to interfere with insertion of the position assurance device between the latching mechanism and the shell when the latching mechanism is out of the latched position.

In some embodiments, the connector may be in combination with a solid state drive. The solid state drive may include a housing comprising an edge having a complimentary latching feature. The complimentary latching feature may be engaged with the latching mechanism, thereby holding the solid state drive in a mated position with respect to the connector.

In some embodiments, the connector may be in combination with a printed circuit board. The tails may be surface mount soldered to the printed circuit board and the shell may be fastened to the printed circuit board with fasteners.

In some embodiments, the shell may include a cavity and a gap. The insulative housing may be disposed within the cavity. The edge of the solid state drive may be disposed within the gap.

In some embodiments, the shell may include a cross bar spanning the width of the cavity.

In some embodiments, the insulative housing may include a recess. The shell may include a tongue extending from the cross bar into the recess.

Some embodiments relate to a connector. The connector may include an insulative housing, a plurality of terminals supported by the insulative housing, and a shell partially surrounding the insulative housing. The terminals may include tails configured for connection to a printed circuit board. The shell may include an outer shell and an inner shell separated by a channel.

In some embodiments, the outer shell may include an L-shaped segment.

In some embodiments, the outer shell may include a second segment, separated from the L-shaped segment by a gap.

In some embodiments, the connector may include a latching mechanism disposed within the gap.

In some embodiments, the latching mechanism may include a rod having a first end coupled to the L-shaped segment and a second end coupled to the second segment. The rod may be elongated in a direction defining an axis of rotation. The latching mechanism may include a member that includes a latching feature mounted on the rod so as to rotate about the axis of rotation.

Some embodiments relate to a shell for an electrical connector. The electrical connector may include an insulative housing and a plurality of terminals disposed in the insulative housing, each of the plurality of terminals including a contact portion and a tail portion, the tail portion protruding from a first mounting face of the insulative housing and capable of being mounted to a first circuit board. The shell may include a body configured for at least partially surrounding the insulative housing and a fixing mechanism for being fixed to the first circuit board.

In some embodiments, the shell may include a locking assembly movably mounted to the body.

In some embodiments, the locking assembly may be configured for locking a second electronic system mounted to the electrical connector in place.

In some embodiments, the locking assembly may include a pivot mounted to the body; a locking member pivotally mounted to the pivot and capable of pivoting about the pivot in a first direction and a second direction opposite to the first direction; and a bias member arranged to act on the locking member such that the locking member tends to pivot towards a locked position in the first direction.

In some embodiments, the locking member may include an actuation portion, the actuation portion, when actuated, causes the locking member to pivot towards a released position in the second direction against the action of the bias member.

In some embodiments, the bias member may be a torsion spring.

In some embodiments, the torsion spring may be disposed around the pivot with an end attached to the locking member and the other end attached to the body or the pivot.

In some embodiments, the locking member may include a pivot plate and a locking portion extending from the pivot plate.

In some embodiments, the pivot plate may be capable of being mounted to the body parallel to the first circuit board when the body is mounted to the first circuit board.

In some embodiments, the pivot plate may be capable of being mounted to the body perpendicular to the first circuit board when the body is mounted to the first circuit board.

In some embodiments, the locking assembly may include a position assurance member configured for retaining the locking member in the locked position.

In some embodiments, the position assurance member may include a tongue configured for to be inserted between the locking member and the body to block the locking member from pivoting in the second direction.

In some embodiments, the body may be formed with a groove and the locking assembly is disposed in the groove.

In some embodiments, the body further may include a second positioning mechanism configured for guiding a positioning of the second electronic system to the electrical connector, when the second electronic system is mounted to the electrical connector.

In some embodiments, the insulative housing further may include a first interfacing face and the body further may include a second interfacing face configured to expose at least a socket in the first interfacing face of the insulative housing. The second positioning mechanism prevents the second electronic system from moving in a direction of the second interfacing face, when the second electronic system is mounted in place.

In some embodiments, the second positioning mechanism is a slot recessed into the body from the second interfacing face.

In some embodiments, the slot may include at least one L-shaped section.

In some embodiments, in the case where the body is formed with the groove, the groove may extend into the slot.

In some embodiments, in the case where the locking assembly may include the locking member, the locking member is capable of being pivoted into the slot.

In some embodiments, the body may include a cavity configured for receiving the insulative housing, and the insulative housing is disposed in the cavity.

In some embodiments, the body may include at least one support mechanism configured for supporting the insulative housing in the cavity.

In some embodiments, the insulative housing further may include a first interfacing face, and the contact portion is accessible through a socket in the first interfacing face, and the support mechanism may include a first support structure configured for supporting the first interfacing face of the insulative housing.

In some embodiments, the first support structure may be a beam extending across an opening of the body that opens to the cavity.

In some embodiments, the insulative housing further may include a first guide mechanism and the body further may include a second guide mechanism The first guide mechanism and the second guide mechanism are configured to cooperate with each other such that the insulative housing is properly positioned in the cavity.

In some embodiments, the first guide mechanism may be a recess formed in the insulative housing and the second guide mechanism may be a platform configured for being inserted into the recess.

In some embodiments, the insulative housing further may include a first interfacing face, and the contact portion may be accessible through a socket in the first interfacing face, and the recess may be recessed into the insulative housing from the first interfacing face.

In some embodiments, the recess may be formed near the socket and the platform provides a mechanical support to the socket when inserted into the recess.

In some embodiments, in the case where the first support structure is the beam extending across the opening of the body that opens to the cavity, the platform may extend into the cavity from the beam.

In some embodiments, the second electronic system may be a solid state drive.

In some embodiments, the second electronic system may be a solid state drive including a housing, and the slot may be configured for receiving an edge of the housing of the solid state drive.

In some embodiments, the shell may be manufactured through die-casting, molding or machining; and/or the body has a thickness of being less than or equal to 10 mm.

In some embodiments, the body may include an inner shell and an outer shell separated by the slot.

Some embodiments relate to a shell for an electrical connector. The electrical connector may include an insulative housing and a plurality of terminals disposed in the insulative housing, each of the plurality of terminals including a contact portion and a tail portion, the tail portion protruding from a first mounting face of the insulative housing and capable of being mounted to a first circuit board. The shell may include: a body configured for at least partially surrounding the insulative housing; and a locking assembly movably mounted to the body.

In some embodiments, the locking assembly may be configured for locking a second electronic system mounted to the electrical connector in place.

In some embodiments, the locking assembly may include: a pivot mounted to the body; a locking member pivotally mounted to the pivot and capable of pivoting about the pivot in a first direction and a second direction opposite to the first direction; and a bias member arranged to act on the locking member such that the locking member tends to pivot towards a locked position in the first direction.

In some embodiments, the locking member may include an actuation portion, when actuated, causing the locking member to pivot towards a released position in the second direction against the action of the bias member.

In some embodiments, the bias member may be a torsion spring.

In some embodiments, the torsion spring may be disposed around the pivot with an end attached to the locking member and the other end attached to the shell or the pivot.

In some embodiments, the locking member may include a pivot plate and a locking portion extending from the pivot plate.

In some embodiments, the pivot plate is capable of being mounted to the body parallel to the first circuit board, when the body is mounted to the first circuit board.

In some embodiments, the pivot plate is capable of being mounted to the body perpendicular to the first circuit board, when the body is mounted to the first circuit board.

In some embodiments, the locking assembly further may include a position assurance member configured for retaining the locking member in the locked position.

In some embodiments, the position assurance member may include a tongue configured for being inserted between the locking member and the body to block the locking member from pivoting in the second direction.

In some embodiments, the body may be formed with a groove and the locking assembly may be disposed in the groove.

In some embodiments, the body further may include a second positioning mechanism configured for guiding a positioning of the second electronic system to the electrical connector, when the second electronic system may be mounted to the electrical connector.

In some embodiments, the insulative housing further may include a first interfacing face and the body further may include a second interfacing face which may be configured to expose at least a socket in the first interfacing face of the insulative housing, and the second positioning mechanism may prevent the second electronic system from moving in a direction of the second interfacing face, when the second electronic system may be mounted in place.

In some embodiments, the second positioning mechanism may be a slot recessed into the body from the second interfacing face.

In some embodiments, the slot may include at least one L-shaped section.

In some embodiments, in the case where the body is formed with a groove, the groove may extend into the slot.

In some embodiments, in the case where the locking assembly may include the locking member, the locking member is capable of pivoting into the slot.

In some embodiments, the body may include a cavity configured for receiving the insulative housing, and the insulative housing may be disposed in the cavity.

In some embodiments, the body may include at least one support mechanism configured for supporting the insulative housing in the cavity.

In some embodiments, the insulative housing further may include a first interfacing face, and the contact portion may be accessible through a socket in the first interfacing face, and the support mechanism may include a first support structure configured for supporting the first interfacing face of the insulative housing.

In some embodiments, the first support structure may be a beam extending across an opening of the body that opens to the cavity.

In some embodiments, the insulative housing further may include a first guide mechanism and the body further may include a second guide mechanism, the first guide mechanism and the second guide mechanism may be configured to cooperate with each other such that the insulative housing may be properly positioned in the cavity.

In some embodiments, the first guide mechanism may be a recess formed in the insulative housing and the second guide mechanism may be a platform configured for being inserted into the recess.

In some embodiments, the insulative housing further may include a first interfacing face, and the contact portion may be accessible through a socket in the first interfacing face, and the recess may be recessed into the insulative housing from the first interfacing face.

In some embodiments, the recess may be formed near the socket and the platform may provide a mechanical support to the socket when inserted into the recess.

In some embodiments, in the case where the first support structure is the beam extending across the opening of the body that opens to the cavity, the platform may extend into the cavity from the beam.

In some embodiments, the second electronic system may be a solid state drive.

In some embodiments, the second electronic system may be a solid state drive including a housing and the slot may be configured for receiving an edge of the housing of the solid state drive.

Some embodiments relate to a shell for an electrical connector. The electrical connector may include an insulative housing and a plurality of terminals disposed in the insulative housing, each of the plurality of terminals may include a contact portion and a tail portion, the tail portion may protrude from a first mounting face of the insulative housing and capable of mounting to a first circuit board. The shell may include a body configured for at least partially surrounding the insulative housing. The body may include a second positioning mechanism which may be configured for guiding the positioning of a second electronic system to the electrical connector, when the second electronic system is mounted to the electrical connector.

In some embodiments, the insulative housing may include a first interfacing face and the body may include a second interfacing face which may be configured to expose at least a socket in the first interfacing face of the insulative housing.

The second positioning mechanism may prevent the second electronic system from moving in a direction of the second interfacing face, when the second electronic system is mounted in place.

In some embodiments, the second positioning mechanism may be a slot recessed into the body from the second interfacing face.

In some embodiments, the slot may include at least one L-shaped section.

In some embodiments, the body may include a groove which may be configured to dispose a locking assembly and extending into the slot.

In some embodiments, the body may include an inner shell and an outer shell separated by the slot.

In some embodiments, the outer shell may include a first L-shaped section and a second straight section separated from each other by the groove.

In some embodiments, the inner shell may include a cavity which may be configured for receiving the insulative housing, and the insulative housing may be disposed in the cavity.

In some embodiments, the inner shell may include at least one support mechanism configured for supporting the insulative housing in the cavity.

In some embodiments, the insulative housing may include a first interfacing face, and the contact portion may be accessible through a socket in the first interfacing face, and the support mechanism may include a first support structure configured for supporting the first interfacing face of the insulative housing.

In some embodiments, the first support structure may be a beam extending across an opening of the inner shell that opens to the cavity.

In some embodiments, the insulative housing may include a first guide mechanism and the inner shell may include a second guide mechanism. The first guide mechanism and the second guide mechanism may be configured to cooperate with each other such that the insulative housing may be properly positioned in the cavity.

In some embodiments, the first guide mechanism may be a recess formed in the insulative housing and the second guide mechanism may be a platform configured to be inserted into the recess.

In some embodiments, the insulative housing further may include a first interfacing face, and the contact portion may be accessible through a socket in the first interfacing face, and the recess may be recessed into the insulative housing from the first interfacing face.

In some embodiments, the recess may be formed near the socket and the platform may provide a mechanical support to the socket when inserted into the recess.

In some embodiments, in the case where the first support structure is the beam extending across the opening of the inner shell that opens to the cavity, the platform may extend into the cavity from the beam.

In some embodiments, the second electronic system may be a solid state drive.

In some embodiments, the second electronic system may be a solid state drive including a housing and the slot may be configured for receiving an edge of the housing of the solid state drive.

Some embodiments relate to an electrical connector assembly. The electrical connector assembly may include an electrical connector including an insulative housing and a plurality of terminals disposed in the insulative housing, each of the plurality of terminals may include a contact portion and a tail portion, the tail portion may protrude from a first mounting face of the insulative housing and may be capable of being mounted to a first circuit board; and the aforesaid shell, the body of the shell at least partially surrounding the electrical connector.

In some embodiments, in the case where the body may include the second guide mechanism, the insulative housing may include a first guide mechanism, the first guide mechanism and the second guide mechanism may be configured to cooperate with each other such that the insulative housing may be properly positioned in the shell.

In some embodiments, the first guide mechanism may be a recess formed in the insulative housing.

In some embodiments, the insulative housing may include a first interfacing face, and the contact portion may be accessible through a socket in the first interfacing face, and the recess may be recessed into the insulative housing from the first interfacing face.

In some embodiments, the recess may be formed near the socket.

In some embodiments, the insulative housing further may include a first positioning mechanism for ensuring that the electrical connector is properly positioned on the first circuit board, when the electrical connector may be mounted to the first circuit board.

In some embodiments, the electrical connector may be a right angle connector or a vertical connector.

These techniques may be used alone or in any suitable combination. The foregoing summary is provided by way of illustration and is not intended to be limiting.

BRIEF DESCRIPTION OF DRAWINGS

The above and other aspects of the present disclosure will be more thoroughly understood and appreciated below when read in conjunction with the appended drawings. It should be noted that the appended drawings are only schematic and are not drawn to scale. In the appended drawings:

FIG. 8A is a perspective view of a system comprising the system of FIG. 4A and the second electronic system of FIG. 7A, illustrating mating the second electronic system shown in FIG. 7A with the electrical connector assembly shown in FIG. 1A, according to some embodiments.

FIGS. 8B to 8D are side views of the system of FIG. 8A, with a portion of the first electronic system and the second electronic system removed, according to some embodiments.

FIG. 8E is a cross-sectional view of the system of FIG. 8A, with a portion of the first electronic system and the second electronic system removed, according to some embodiments.

LIST OF REFERENCE NUMERALS

Figure 1A:
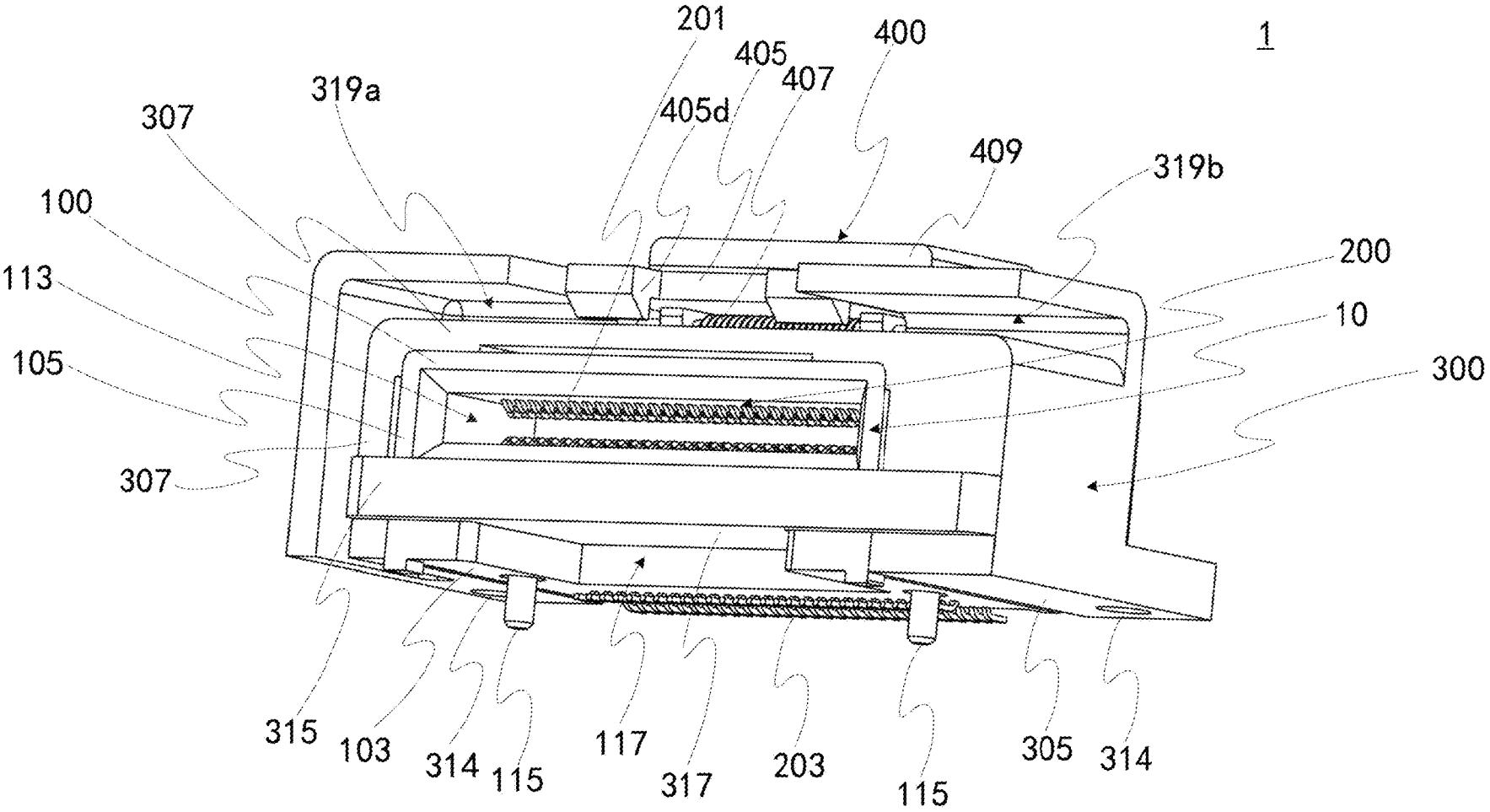
FIG. 1A is a front, side perspective view of an electrical connector assembly, according to some embodiments.

1 electrical connector assembly
10 right angle connector
100 insulative housing
101 top face
103 bottom face
105 front side face
107 rear side face
109 left side face
111 right side face
113 socket
115 positioning protrusion
117 recess
200 terminals
201 contact portion
203 tail portion
300 shell
301 body
301*a* outer shell
301*b* inner shell
303 top face
305 bottom face
306 cavity
307 front side face
308 first opening
309 rear side face
310 second opening
311 left side face
312 third opening
313 right side face
314 threaded hole
315 first beam
317 platform
319*a* first section
319*b* second section
321 groove
400 locking assembly
401 pivot
403 first direction
405 locking member
405*a* body
405*b* top face
405*c* bottom face
405*d* barb
405*e* mounting portion
405*f* actuation portion
407 bias member
409 position assurance member
409*c* tongue
500 first circuit board
501 surface
600 bolt
700 second electronic system
701 housing
703 second circuit board
705 conductive portion
707 opening
709 edge
711 dimple
S space.

DETAILED DESCRIPTION

Described herein is an electrical connector assembly that provides robust and reliable electrical connections, such as to a solid state drive (SSD) or other electronic subassembly. The electrical connector assembly may include an electrical connector and a shell partially surrounding an insulative housing of the electrical connector. The insulative housing may have a mating face with a socket formed therein. The socket can receive a first printed circuit board of a first electronic device such as an SSD. The shell may include a die cast body that has an outer shell and an inner shell separated by a slot. The inner shell may include an opening and the insulative housing is disposed within the opening. The slot may receive an edge of a housing of the first electronic device. Such a configuration may prevent the SSD from moving in either the horizontal or vertical direction, which could cause the SSD to either come unmated or could provide a twisting force on the connector that might break surface mount solder connections between the connector and the mother board or otherwise damage the connector or the SSD. The shell may include features attached to a second electronic device such as a second printed circuit board (e.g., a motherboard). The shell may include a latching mechanism movably mounted to the body. Such configuration may enable a robust and reliable electrical connection between the first electronic system and the second electronic system.

Preferred embodiments of the present disclosure are described in detail below in conjunction with some examples. It should be appreciated by the skilled person in the art that these embodiments are not meant to form any limitation on the present disclosure.

FIGS. 1A to 1G illustrate an electrical connector assembly 1 according to a preferred embodiment of the present disclosure. As shown in FIGS. 1A to 1G, the electrical connector assembly 1 may include a right angle connector 10 and a shell 300 at least partially surrounding the right angle connector 10. The right angle connector 10 may include an insulative housing 100 and a plurality of terminals 200 disposed in the insulative housing 100. The shell 300 may at least partially surround the insulative housing 100 of the right angle connector 10.

Referring to FIGS. 2A to 2E, FIGS. 2A to 2E illustrate the insulative housing 100 and the plurality of terminals 200 disposed in the insulative housing 100 of the right angle connector 10 in detail. The insulative housing 100 may have a substantially block-shaped body and may include a top face 101, a bottom face 103 opposite to the top face 101 and four sides faces extending between the top face 101 and the bottom face 103, i.e., front side face 105, rear side face 107, left side face 109 and right side face 111. Examples of materials that are suitable for forming the insulative housing 100 include, but are not limited to, plastic, nylon, liquid crystal polymer (LCP), polyphenyline sulfide (PPS), high temperature nylon or polyphenylenoxide (PPO) or polypropylene (PP).

The plurality of terminals 200 may be housed in the insulative housing 100. Each of the plurality of terminals 200 may be formed of a conductive material. Conductive materials that are suitable for forming the terminals 200 may be a metal, such as copper, or a metal alloy. The plurality of terminals 200 may be configured to transmit differential signals between a first electronic system, such as a circuit board, and a second electronic system, such as an SSD. In some examples, the plurality of terminals 200 may be provided in a plurality of sets, with each set including three terminals 200, i.e., a ground terminal, a first signal terminal and a second signal terminal. The first signal terminal and the second signal terminal may constitute a differential signaling pair. Each of the plurality of terminals 200 includes a contact portion 201, a tail portion 203 and a body portion (not shown) extending between the contact portion 201 and the tail portion 203. The terminal 200 may be bent such that the tail portion 203 can extend at a substantially right angle relative to the contact portion 201. The tail portion 203 may be configured to be mounted (for example, by soldering) onto the first electronic system. The contact portion 201 may be configured to establish an electrical contact with a conductive portion of the second electronic system.

A plurality of sets of three terminals 200 may be arranged in terminal rows, with the terminals in each terminal row aligned therein. As shown in FIGS. 2A to 2E, when the terminals 200 are disposed in the insulative housing 100, the terminals 200 are arranged in two terminal rows which are mutually opposed and spaced apart, with the terminals in each terminal row aligned therein. The two terminal rows may be spaced apart in a manner that the terminals 200 are offset from each other or aligned with each other along an arrangement direction. The conductive portion of the second electronic system may be inserted between the two terminal rows such that the conductive portion of the second electronic system is arranged in contact with the contact portions 201 of the corresponding terminals 200. It should be appreciated that the terminals 200 may also be arranged in other suitable manners.

In some embodiments, the insulative housing 100 may be overmolded directly around the terminals 200 to retain the plurality of terminals 200 in position relative to each other. In some embodiments, the right angle connector 10 may include at least one retention mechanism (not shown) to retain the plurality of terminals 200 in position relative to each other. The retention mechanism may be partially or entirely formed of an insulative material. Examples of materials that are suitable for forming the retention mechanism include, but are not limited to, plastic, nylon, liquid crystal polymer (LCP), polyphenyline sulfide (PPS), high temperature nylon or polyphenylenoxide (PPO) or polypropylene (PP). In some examples, at least one retention mechanism may be overmolded around a plurality of terminals 200. In some examples, at least one retention mechanism may be formed separately from the insulative housing 100 and be movably mountable into the insulative housing 100. It should be appreciated that the right angle connector 10 may have other suitable numbers/forms of retention mechanisms.

Figure 2A:
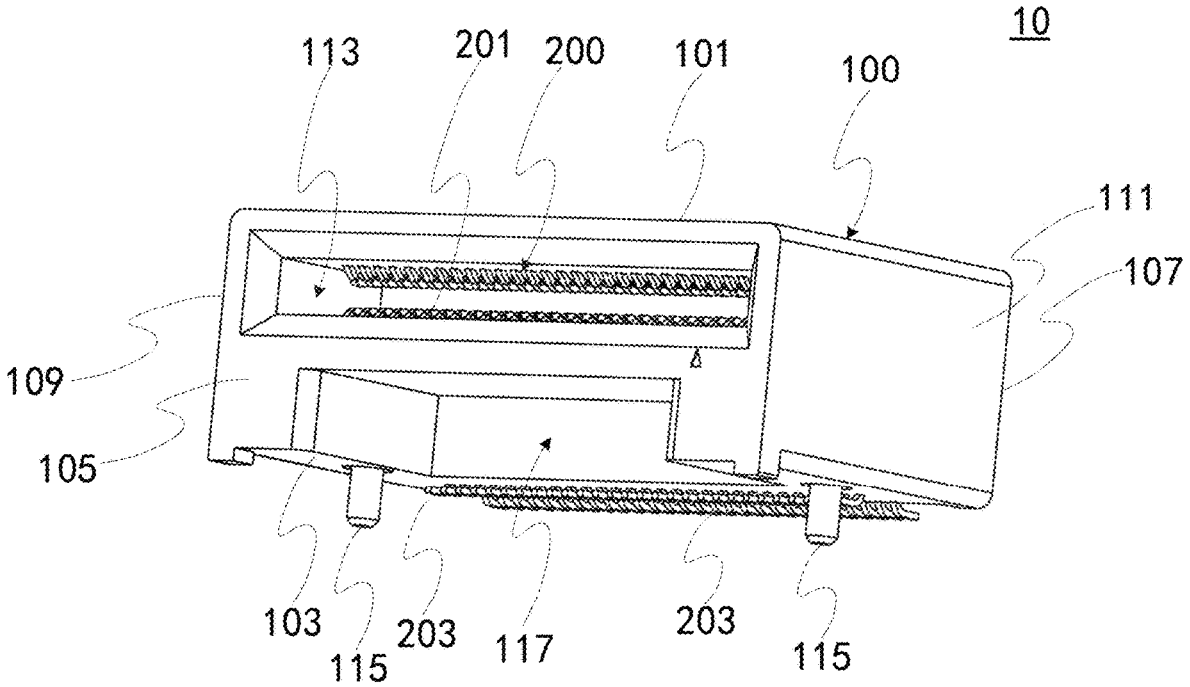
FIG. 2A is a perspective view of the right angle connector of the electrical connector assembly shown in FIG. 1A.
Figure 2B:
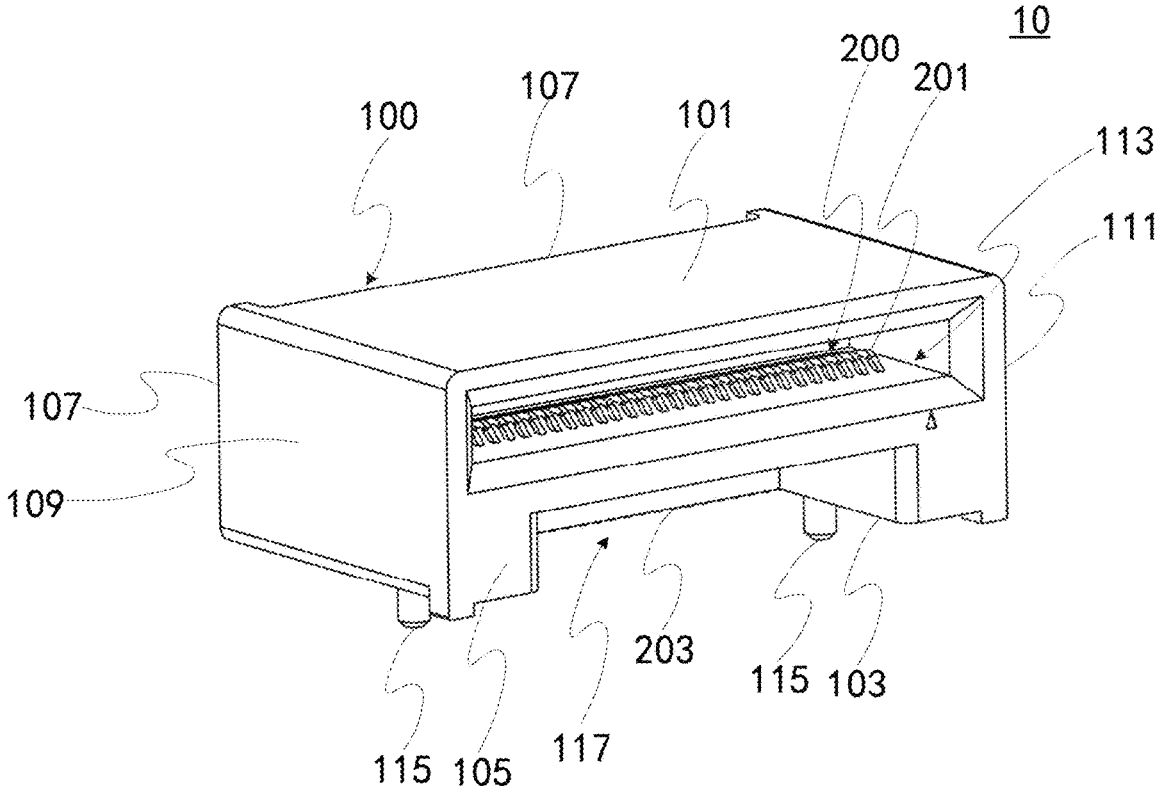
FIG. 2B is another perspective view of the right angle connector shown in FIG. 2A.
Figure 2C:
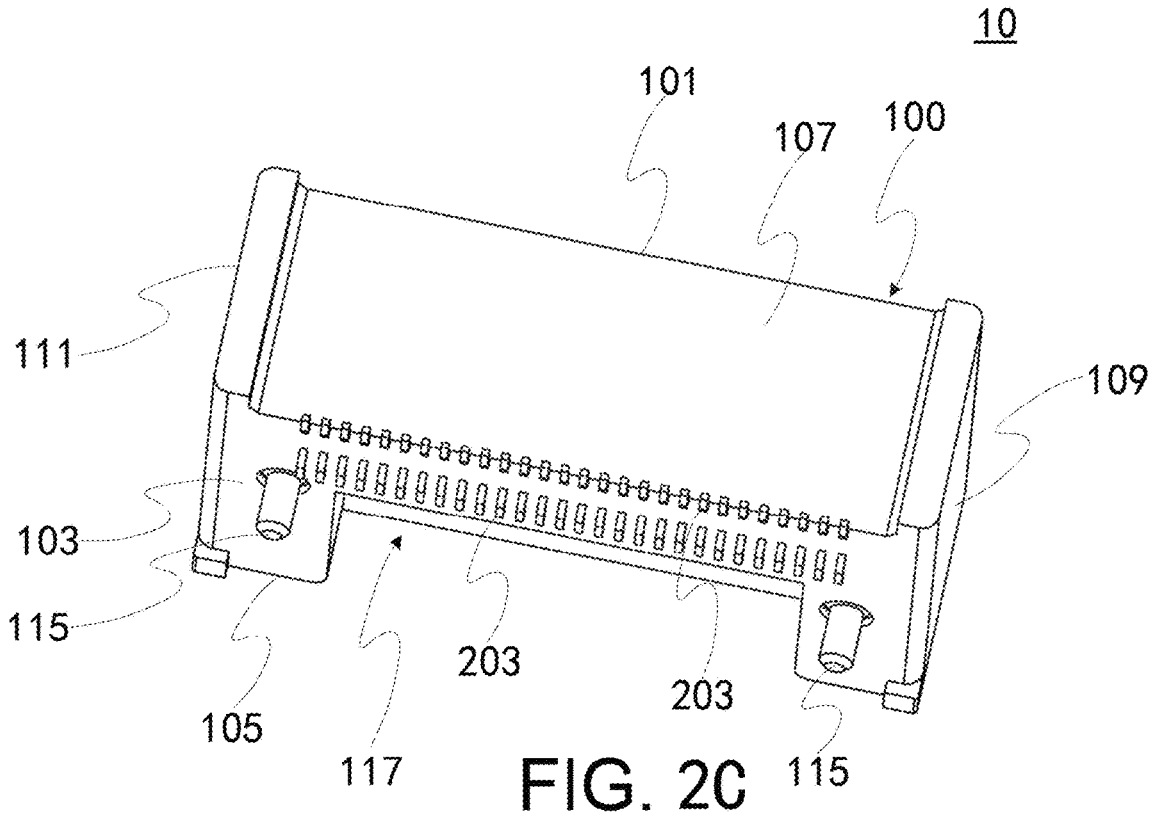
FIG. 2C is yet another perspective view of the right angle connector shown in FIG. 2A.
Figure 2D:
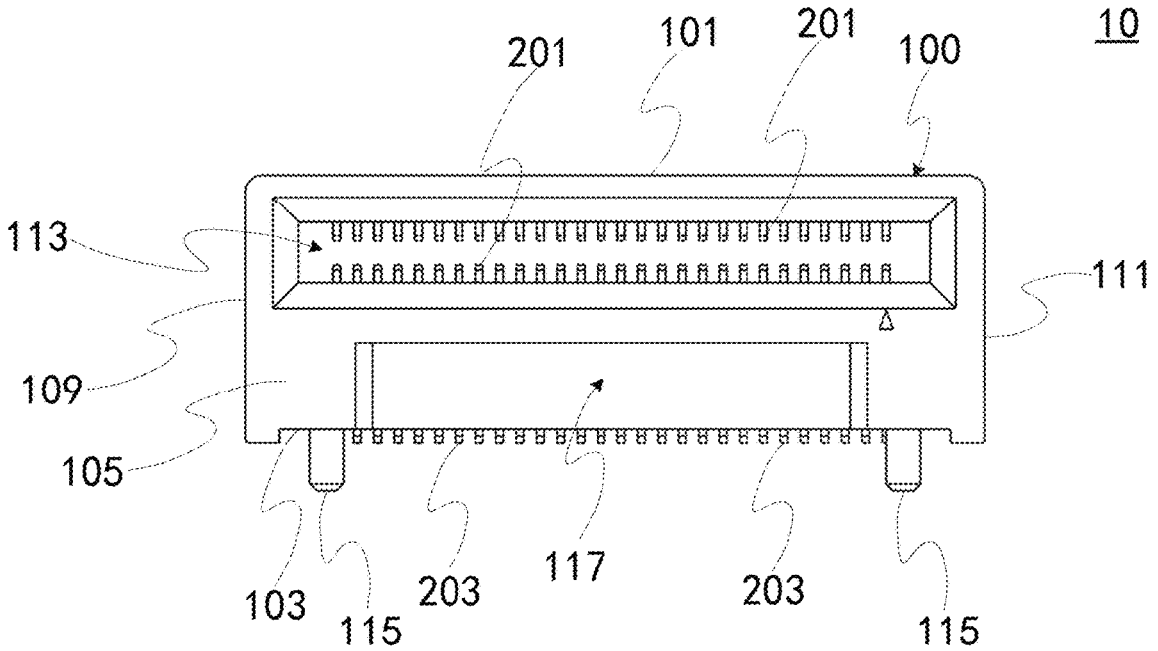
FIG. 2D is a front plan view of the right angle connector shown in FIG. 2A.
Figure 2E:
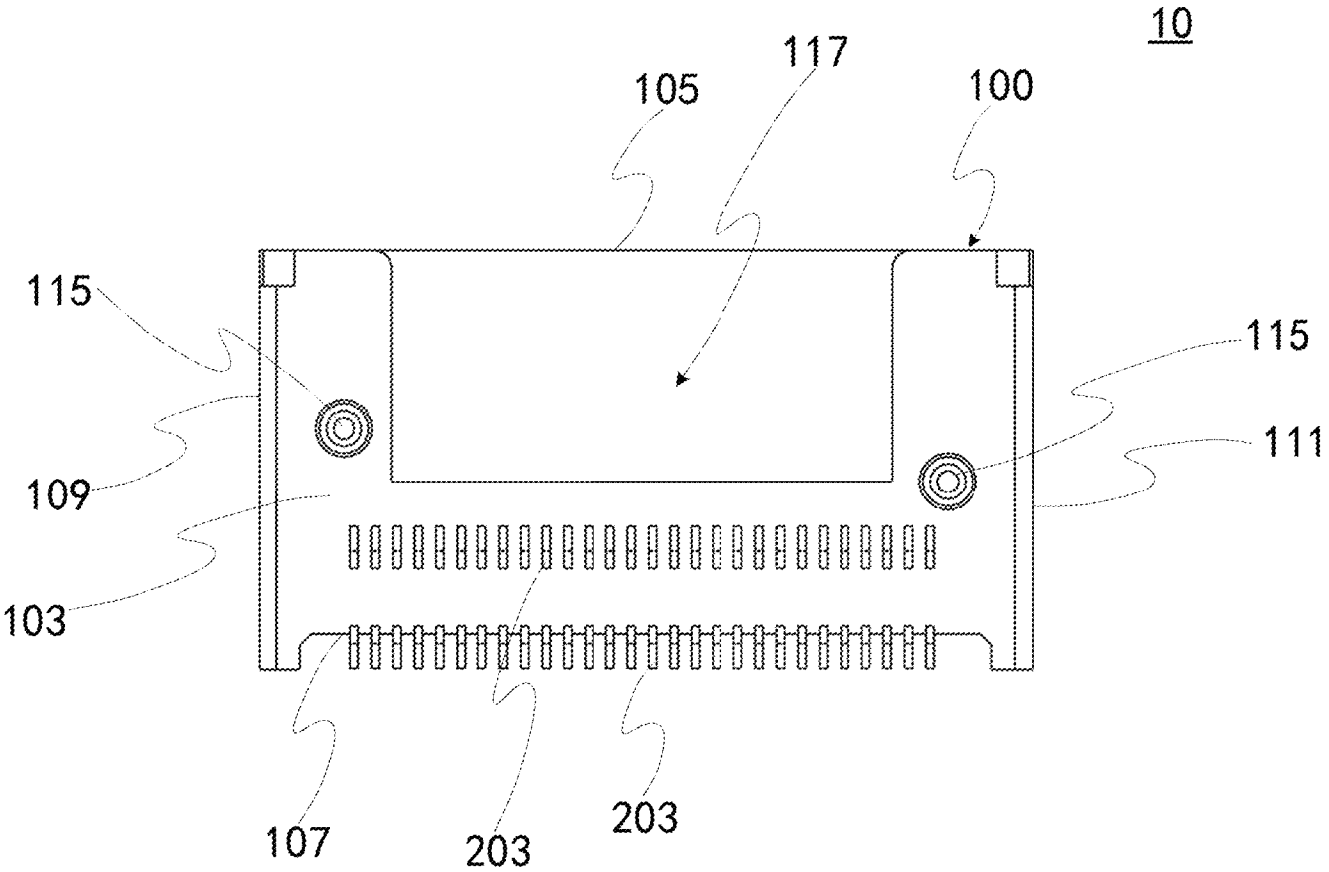
FIG. 2E is a bottom plan view of the right angle connector shown in FIG. 2A.

One of the four side faces of the insulative housing 100 may have at least one socket, such that the contact portion 201 of each of the plurality of terminals 200 is accessible through the socket. The side face may also be referred to as "a first interfacing face". The second electronic system may be interfaced with the insulative housing 100 from the first interfacing face. For example, the conductive portion of the second electronic system, such as an SSD, may be inserted between two terminal rows through the socket in the first interfacing face, such that the conductive portion of the second electronic system is arranged in contact with the contact portions 201 of the corresponding terminals 200. In this way, the conductive portion of the second electronic system may be electrically connected to the corresponding conductive portion of the first electronic system, such as a motherboard, via the terminals 200, thereby establishing an electrical connection between the second electronic system and the first electronic system. The first electronic system and the second electronic system may communicate with each other through the right angle connector 10 using a standardized protocol, such as a PCI protocol. As shown in FIGS. 2A, 2B and 2D, the front side face 105 of the insulative housing 100 may have a socket 113, and the contact portions 201 of the respective terminals in the two terminal rows, which are mutually opposed and spaced apart, are positioned in the socket 113, such that the contact portions 201 of the plurality of terminals 200 are accessible through the socket 113. It should be appreciated that the front side face 105 of the insulative housing 100 may have other numbers of sockets, such as two or more sockets, such that the contact portions 201 of the plurality of terminals 200 may be accessible through the sockets, respectively. It should also be appreciated that the number of sockets may be the same as or different from that of retention mechanisms. For example, when the insulative housing 100 has two sockets, two retention mechanisms may be provided accordingly to retain the plurality of terminals 200 in position relative to each other and to allow the contact portions 201 of the terminals 200 to be accessible through the two sockets, respectively.

With continuing reference to FIGS. 2A to 2E, when the terminals 200 are retained in the insulative housing 100, the tail portion 203 of each terminal 200 protrudes from the insulative housing 100 at an approximately right angle relative to the contact portion 201. The contact portion 201 of each terminal 200 may be accessible through the socket 113 in the front side face 105 of the insulative housing 100, and the tail portion 203 of each terminal 200 may be disposed to protrude from the bottom face 103 (which may also be referred to as the "first mounting face") of the insulative housing 100 for being mounted to the first electronic system, such as a motherboard. For example, the tail portions 203 of the terminals 200 in the two terminal rows may be bent in opposite directions so as to be connected to the corresponding conductive portions of the first electronic system. The connections may be achieved by soldering or any other suitable means.

The right angle connector 10 may further include a first positioning mechanism provided on the insulative housing 100 for ensuring the proper positioning of the right angle connector 10 on the first electronic system when the right angle connector 10 is mounted to the first electronic system, such as a motherboard, and for preventing the insulative housing 100 from moving along a surface of the first electronic system. For example, the first positioning mechanism may be in the form of a positioning protrusion, two positioning protrusions 115 are shown in FIGS. 2A to 2E. The two positioning protrusions 115 may be provided on the bottom face 103 of the insulative housing 100, near the opposite ends of the insulative housing 100, respectively. However, it should be appreciated that the two positioning protrusions 115 may also be provided at any other suitable location. The positioning protrusions 115 may be designed to provide a dummy-proof design to prevent the right angle connector 10 from being intentionally or unintentionally mounted in a wrong orientation on the first electronic system. As the right angle connector 10 is mounted to the first electronic system, the positioning protrusions 115 may cooperate with a corresponding positioning mechanism (for example, a recess or hole) of the first electronic system to ensure that the right angle connector 10 is properly positioned on the first electronic system and to prevent the movement of the insulative housing 100 along the surface of the first electronic system. It should be appreciated that the first positioning mechanism may also be in any other suitable form.

In order to allow the right angle connector 10 to provide a reliable electrical connection between the first electronic system, such as a motherboard, and the second electronic system, such as an SSD, the electrical connector assembly 1 may further include a shell 300 for improving the reliability of the connection among the right angle connector 10 and the first and second electronic systems.

With continuing reference to FIGS. 3A to 3E, FIGS. 3A to 3E illustrate the shell 300 of the electrical connector assembly 1 in detail. The shell 300 may have a substantially block-shaped body 301, which may include a top face 303, a bottom face 305 opposite to the top face 303 and four side faces extending between the top face 303 and the bottom face 305, i.e., a front side face 307, a rear side face 309, a left side face 311 and a right side face 313.

The body 301 may further include a cavity 306 configured for receiving the insulative housing 100 of the right angle connector 10. As shown in FIGS. 1A to 1G, when the insulative housing 100 is disposed in the cavity 306, the body 301 may at least partially surround the insulative housing 100, so as to expose at least the positioning protrusions 115 on the first mounting face (i.e., the bottom face 103 in the drawings) of the insulative housing 100, the tail portions 203 of the terminals 200 protruding from the first mounting face and the socket 113 in the first interfacing face (i.e., the front side face 105 in the drawings). In particular, the front side face 307 of the body 301 may include a first opening 308 configured to open to the cavity 306 so as to expose at least the socket 113 in the first interfacing face (i.e., the front side face 105) of the insulative housing 100 when the insulative housing 100 is received in the cavity 306. The front side face 307 of the shell 300 may also be referred to as "a second interfacing face". The bottom face 305 of the body 301 may include a third opening 312 configured to open to the cavity 306 so as to expose at least the positioning protrusions 115 on the first mounting face of the insulative housing 100 and the tail portions 203 of the terminals 200 protruding from the first mounting face, when the insulative housing 100 is received in the cavity 306. The bottom face 305 of the shell 300 may also be referred to as "a second mounting face". In addition, the rear side face 309 of the body 301 may include a second opening 310 configured to open to the cavity 306 so as to allow the insulative housing 100 to be inserted into the cavity 306 therethrough.

The shell 300 may further include a fixing mechanism being fixed to the first electronic system, such as a motherboard. In some examples, the body 301 of the shell 300 may be formed with a mounting hole. FIGS. 3A to 3E illustrate two mounting holes 314 that are configured such that the shell 300 may be fixed to the first electronic system by bolts. As shown, the two mounting holes 314 may be formed at corner portions between adjacent side faces of the shell 300, respectively. It should be appreciated that the shell 300 may include other suitable numbers/forms of fixing mechanisms.

Figure 4A:
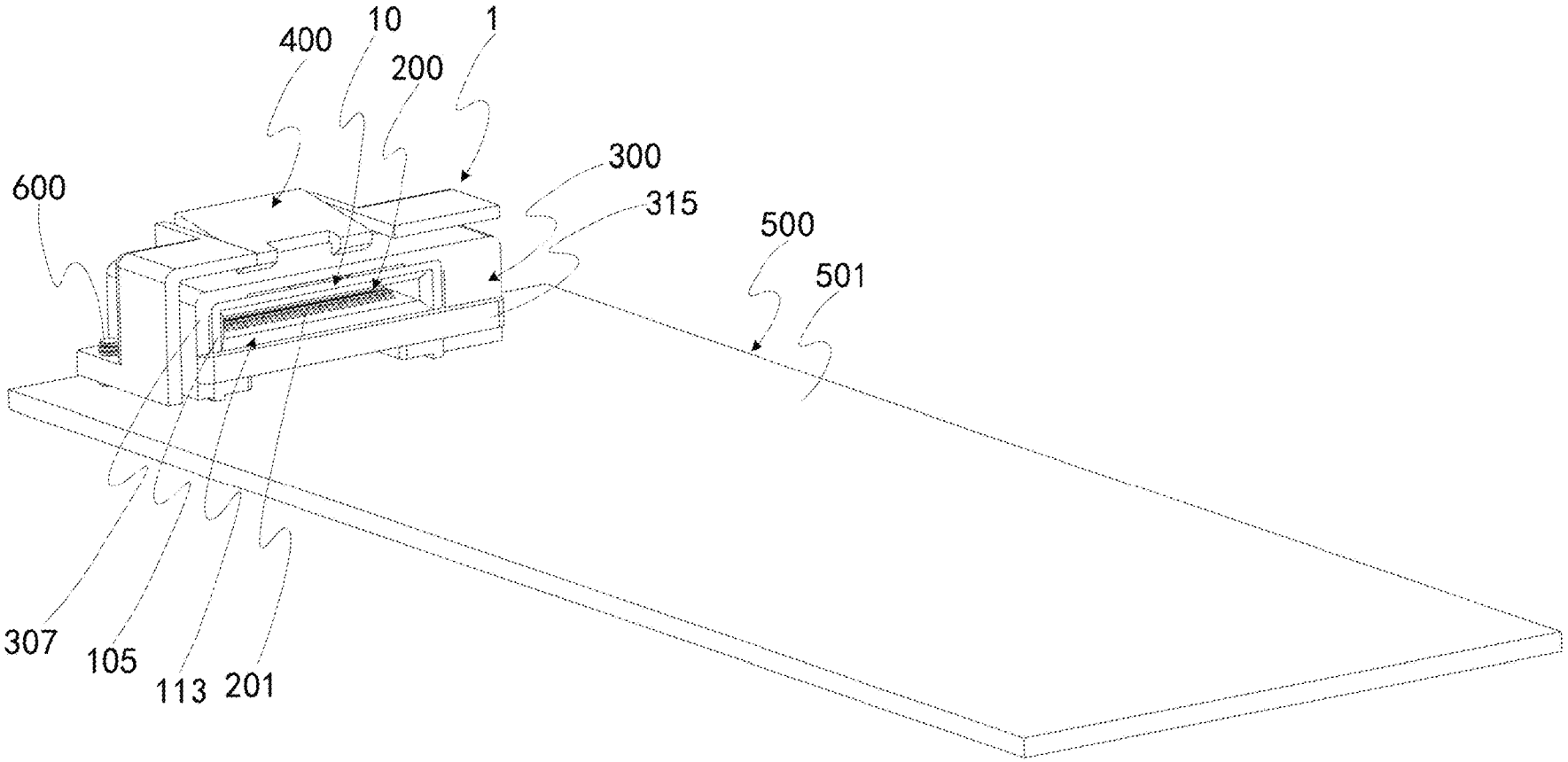
FIG. 4A is a perspective view of a system comprising a first electronic system such as a first circuit board and the electrical connector assembly shown in FIG. 1A mounted to the first electronic system, according to some embodiments.
Figure 4B:
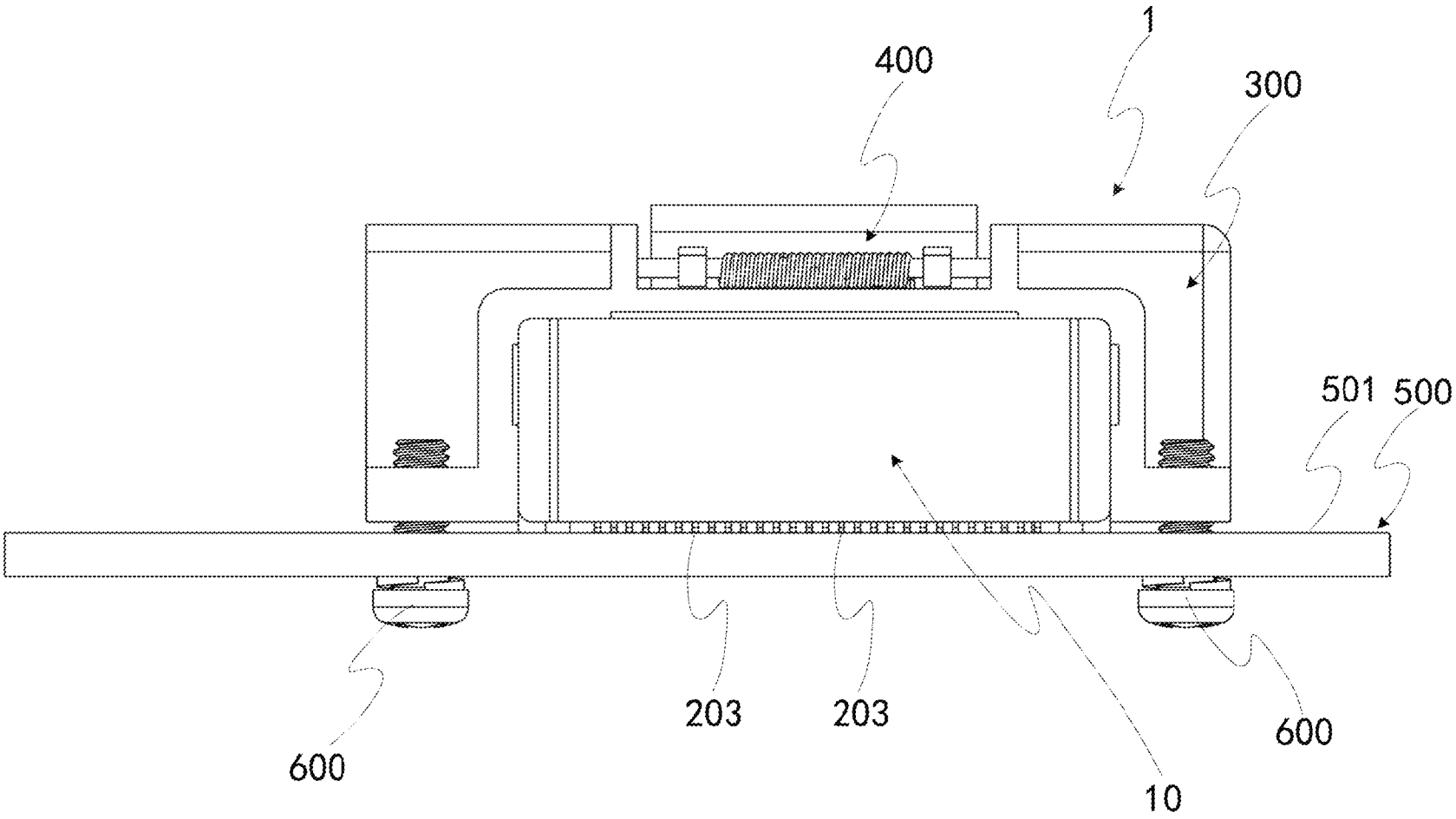
FIG. 4B is a plan view of the system of FIG. 4A.

With continuing reference to FIGS. 4A and 4B, the electrical connector assembly 1 may be fixed to the first electronic system, such as a first circuit board 500, by the fixing mechanism of the shell 300. The first circuit board may be, for example, a motherboard for a computer. In some examples, the insulative housing 100 of the right angle connector 10 may be disposed in the cavity 306 of the shell 300. The right angle connector 10 may then be properly positioned onto the surface 501 of the first circuit board 500 by mating the first positioning mechanism on the insulative housing 100 with the corresponding positioning mechanism (not shown) of the first circuit board 500. The first positioning mechanism on the insulative housing 100 may prevent the insulative housing 100 from moving along the surface 501 of the first circuit board 500. The tail portions 203 of the terminals 200 protruding from the bottom face 103 of the insulative housing 100 are mounted (e.g., by soldering) to the corresponding conductive portions on the surface 501 of the first circuit board 500. The bolts 600 may then be provided such that threaded portions of the bolts 600 are screwed into the mounting holes 314 of the shell 300 through the holes (not shown) in the first circuit board 500, thereby connecting the shell 300 to the first circuit board 500. As such, the electrical connector assembly 1 is fixed to the first circuit board 500.

When the electrical connector assembly 1 is fixed to the first circuit board 500 by the fixing mechanism of the shell 300, the body 301 of the shell 300 may at least partially surround the insulative housing 100 and provide a mechanical support to the insulative housing 100 so as to prevent the insulative housing 100 from moving away from its mounting position. This may improve the reliability of the connection between the right angle connector 10 and the first electronic system, such as the first circuit board 500, thereby allowing that the right angle connector 10 is mounted to the first electronic system in a more secure manner. In this way, it is possible to avoid the risk that the electrical connection between the right angle connector 10 and the first electronic system, such as the soldering between the tail portions 203 of the terminals 200 of the right angle connector 10 and the conductive portions of the first circuit board 500, is damaged, due to the movement of the insulative housing 100 away from its mounting position.

Since the movement of the insulative housing 100 along the surface 501 of the first circuit board 500 is prevented only by the cooperation of the first positioning mechanism on the insulative housing 100 with the corresponding positioning mechanism of the first circuit board 500, for example, when the second electronic system, such as an SSD, is pulled out of the socket 133 of the insulative housing 100, pulling force acts on a portion of the first positioning mechanism of the insulative housing 100 mating with the corresponding positioning mechanism of the first circuit board 500, which may result in a stress concentration between the first positioning mechanism of the insulative housing 100 and the corresponding positioning mechanism of the first circuit board 500. The stress concentration may cause damage to the first positioning mechanism of the insulative housing 100 and the corresponding positioning mechanism of the first circuit board 500, which may in turn result in the breakage of the electrical connection between the right angle connector 10 and the first electronic system.

To mitigate this stress concentration, the body 301 of the shell 300 may further include at least one support mechanism configured for supporting the insulative housing 100. In some examples, the body 301 includes a first support mechanism configured for supporting the first interfacing face of the insulative housing 100. As shown in FIGS. 3A to 3E, the first support mechanism may be in the form of a first beam 315 extending across the first opening 308 of the front side face 307. The first beam 315 may be configured for supporting the front side face 105 of the insulative housing 100. The first beam 315 may provide a mechanical support to the insulative housing 100 when the second electronic system, such as an SSD, is pulled out of the socket 133 of the insulative housing 100 so as to reduce or even eliminate the stress concentration that occurs between the first positioning mechanism of the insulative housing 100 and the corresponding positioning mechanism of the first circuit board 500, avoiding the breakage of the first positioning mechanism of the insulative housing 100 and the corresponding positioning mechanism of the first circuit board 500, thereby improving the reliability of the electrical connection between the right angle connector 10 and the first circuit board 500. It should be appreciated that the first support mechanism may be in other suitable forms.

It should be appreciated that the body 301 of the shell 300 may optionally include a second support mechanism (not shown) configured for supporting the face of the insulative housing 100 opposite to the first interfacing face. For example, the second support mechanism may be configured for supporting the rear side face 107 of the insulative housing 100. The second support mechanism may provide a mechanical support to the insulative housing 100 when the second electronic system, such as an SSD, is inserted into the socket 133 of the insulative housing 100 so as to reduce or even eliminate the stress concentration that occurs between the first positioning mechanism of the insulative housing 100 and the corresponding positioning mechanism of the first circuit board 500, avoiding the breakage of the first positioning mechanism of the insulative housing 100 and the corresponding positioning mechanism of the first circuit board 500, thereby improving the reliability of the electrical connection between the right angle connector 10 and the first circuit board 500. It should also be appreciated that the second support mechanism may be in the form of a beam or any other suitable forms.

The insulative housing 100 may further include a first guide mechanism and the shell 300 may further include a second guide mechanism. The first guide mechanism of the insulative housing 100 and the second guide mechanism of the shell 300 may be configured to cooperate with each other such that the insulative housing 100 may be properly positioned in the cavity 306 of the shell 300. In some examples, as shown in FIGS. 2A to 2E and 3A to 3E, the first guide mechanism may be a recess 117 formed in the body of the insulative housing 100 and the second guide mechanism may be a platform 317 extending from the body 301 of the shell 300 and configured for being inserted into the recess 117. When the insulative housing 100 is mounted into the cavity 306 of the shell 300, the platform 317 of the shell 300 may cooperate with the recess 117 of the insulative housing 100 so as to guide the insulative housing 100 into the cavity 306 of the shell 300, such that the insulative housing 100 may be properly positioned in the cavity 306 of the shell 300. In some examples, the platform 317 may extend into the cavity 306 from the first beam 315 of the body 301, and the recess 117 may be recessed into the insulative housing 100 from the first interfacing face (i.e., the front side face 105). In some examples, the recess 117 may be recessed into the insulative housing 100 from the first interfacing face (i.e., the front side face 105) near the socket 113, for example below the socket 113 as shown. In this case, the platform 317 extends into the recess 117 such that the socket 113 may be substantially surrounded by the body 301 of the shell 300, thereby providing a mechanical support to the socket 133. This can help prevent the socket 133 from being damaged due to inserting or pulling out (e.g., obliquely inserting or pulling out) the second electronic system in a wrong direction.

Figure 3A:
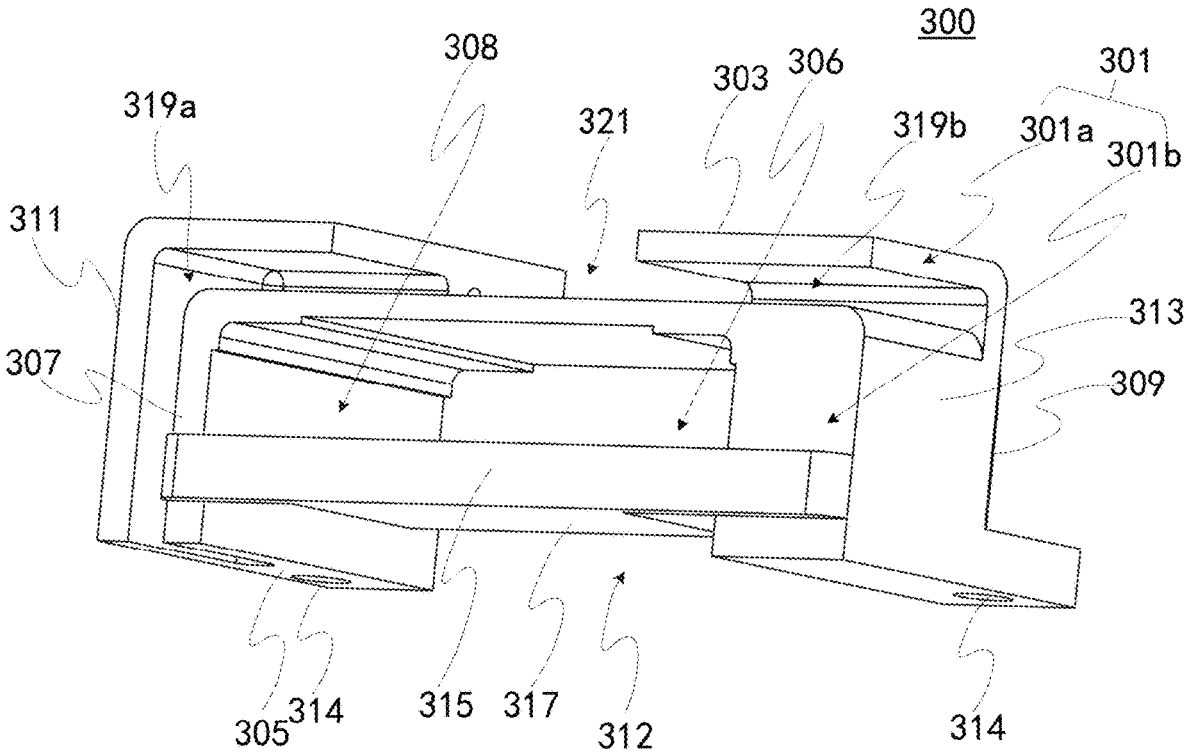
FIG. 3A is a perspective view of a shell of the electrical connector assembly shown in FIG. 1A.
Figure 3B:
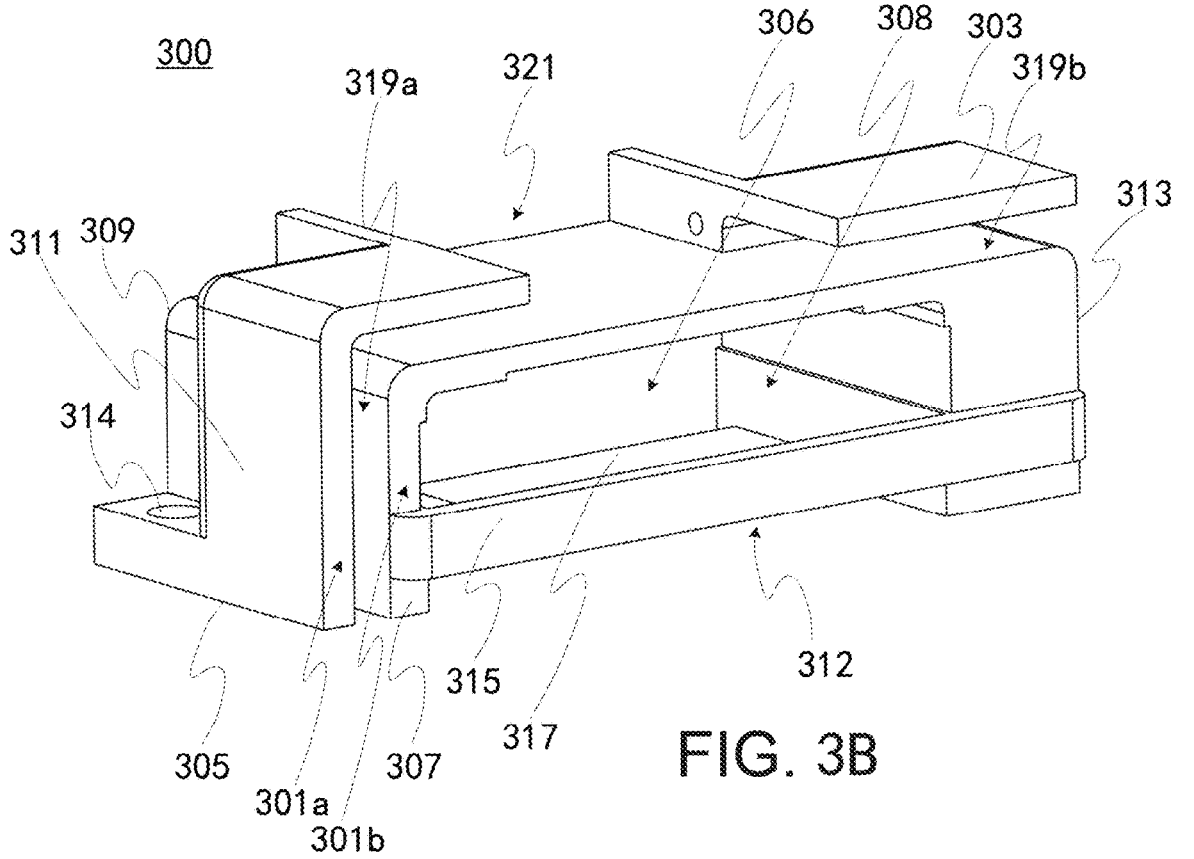
FIG. 3B is another perspective view of the shell shown in FIG. 3A.
Figure 3C:
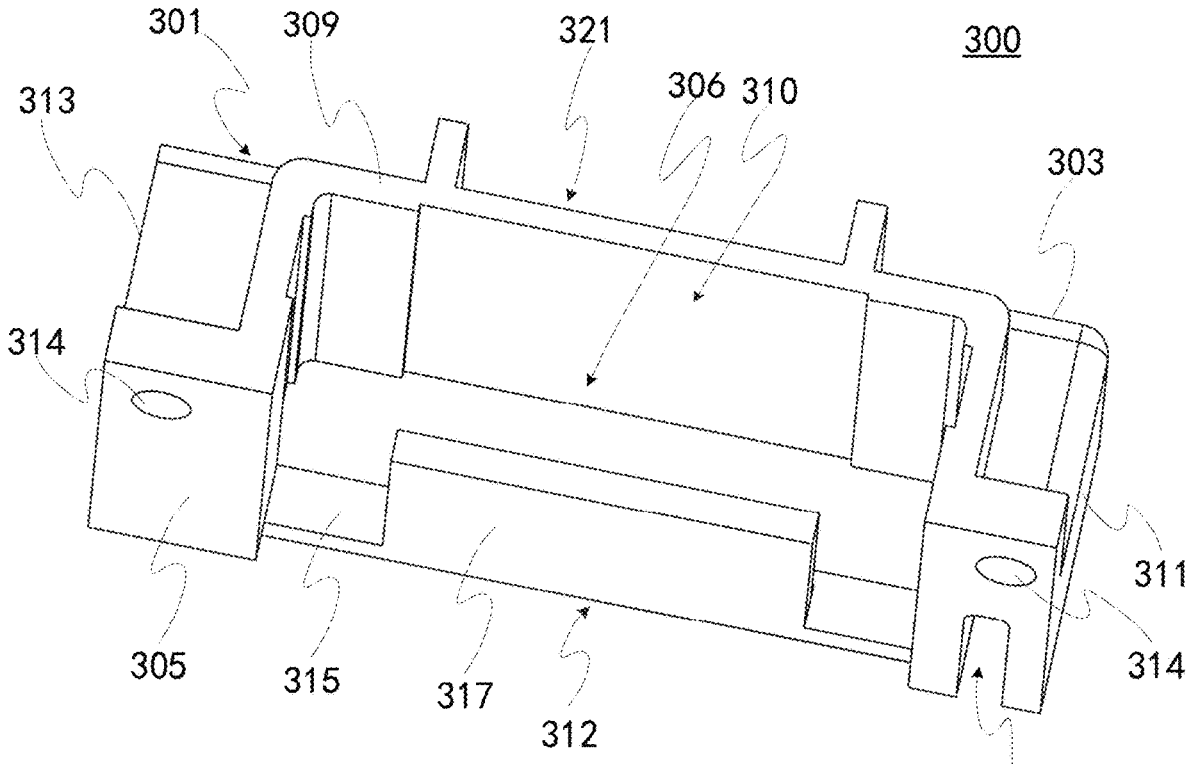
FIG. 3C is yet another perspective view of the shell shown in FIG. 3A.
Figure 3D:
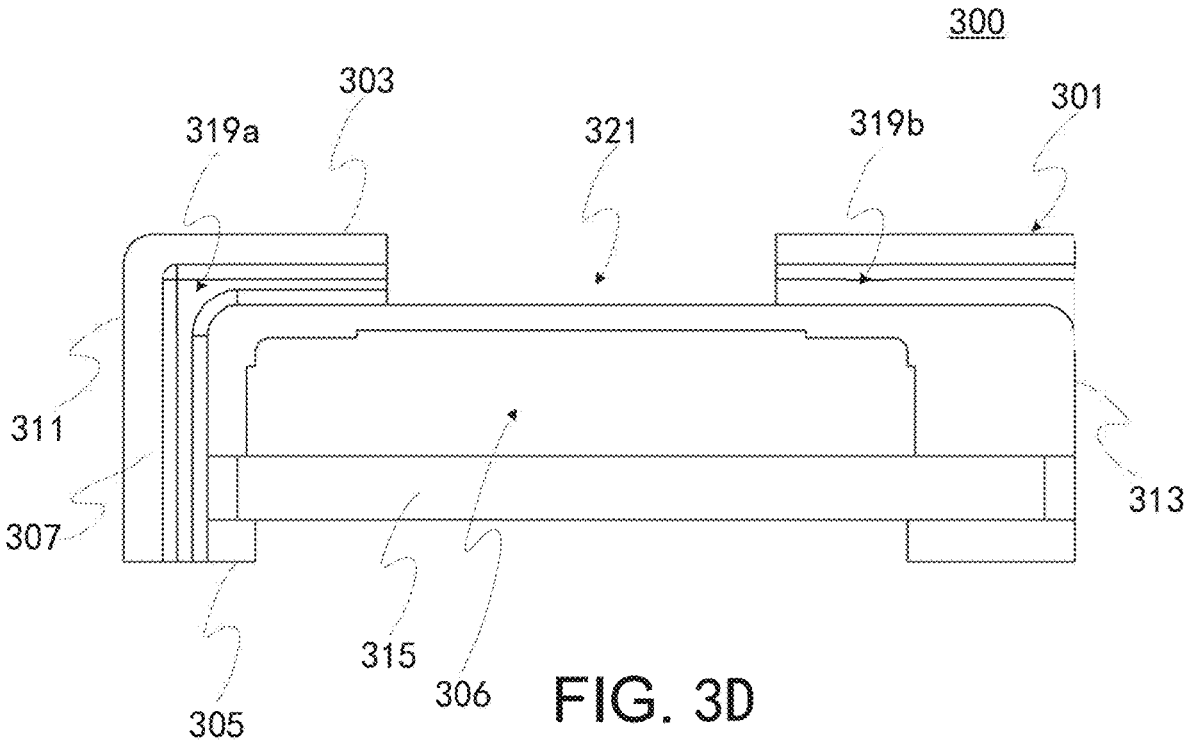
FIG. 3D is a front plan view of the shell shown in FIG. 3A.
Figure 3E:
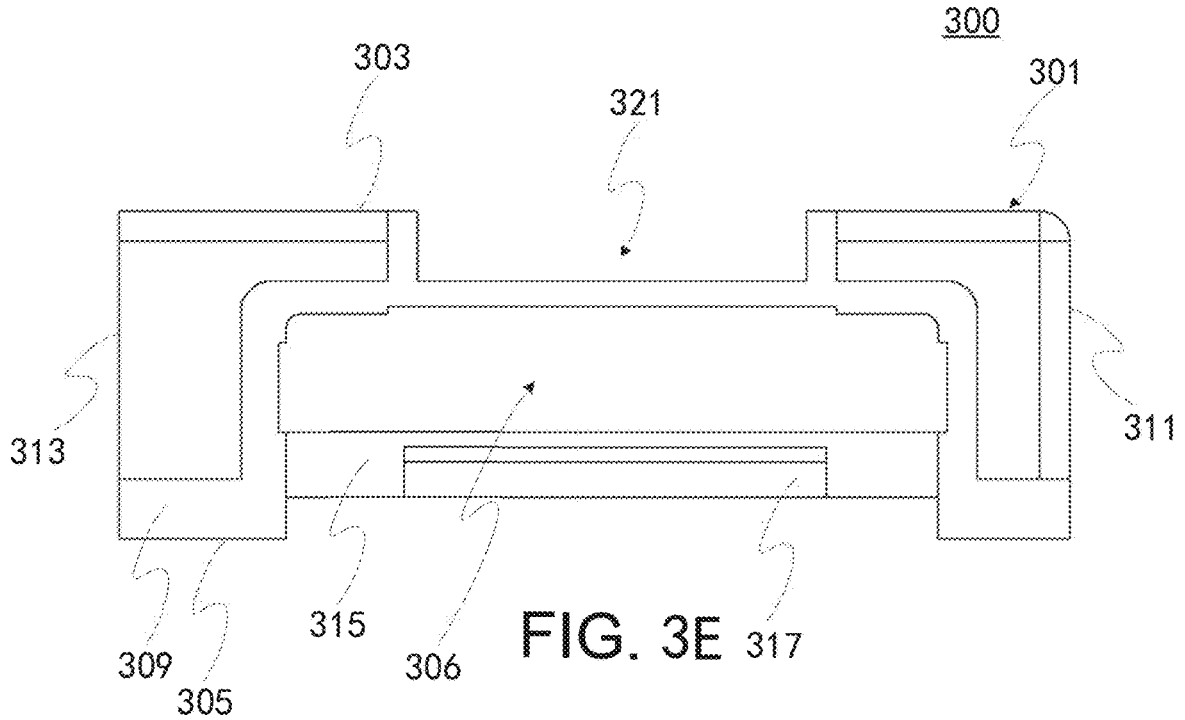
FIG. 3E is a rear plan view of the shell shown in FIG. 3A.

The shell 300 may further include a second positioning mechanism provided in the second interfacing face (i.e., the front side face 307), the second positioning mechanism may be configured for cooperating with the corresponding positioning mechanism of the second electronic system, such as an SSD, to ensure that the second electronic system is properly connected to the right angle connector 10 and to retain the second electronic system in place when the second electronic system is mounted in place and to prevent the second electronic system from moving along the plane of the second interfacing face. In some examples, the second positioning mechanism may be a slot recessed into the body 301 from the front side face 307 of the shell 300. In some examples, as shown in FIG. 3A, the body 301 includes an outer shell 301*a* and an inner shell 301*b* separated by the slot. In this case, the inner shell 301*b* may include a cavity 306 configured for receiving the insulative housing 100. In some examples, the inner shell 301*b* may further include at least one support mechanism configured for supporting the insulative housing 100. In some examples, the inner shell 301*b* includes a first support mechanism configured for supporting the first interfacing face of the insulative housing 100. In some examples, as shown in FIG. 3A, the first support mechanism may be in the form of a first beam 315 extending across the first opening 308 in the front side face 307 of the inner shell 301*b*. The first beam 315 may be configured for supporting the front side face 105 of the insulative housing 100. In some examples, the slot may extend at least partially around the first opening 308 in the front side face 307. The slot may include a first L-shaped section 319*a* and a second straight section 319*b* spaced apart from the first section 319*a*. It should be appreciated that the first section 319*a* and the second section 319*b* may also be continuous, or the slot may include more sections. Correspondingly, as shown, the outer shell 301*a* may include a first L-shaped section and a second straight section spaced apart from the first section. It should also be appreciated that the slot may include two or more L-shaped sections.

The corresponding positioning mechanism of the second electronic system may be an edge of the housing or other mechanism provided on the housing of the second electronic system. When the second electronic system is mounted to the right angle connector 10, the slot may receive the corresponding positioning mechanism of the second electronic system to guide the second electronic system to be properly connected to the right angle connector 10 and to retain the second electronic system in place when the second electronic system is mounted in place and to prevent the second electronic system from moving along the plane of the front side face 307 of the shell 300. In this way, it is possible to improve the reliability of the connection between the right angle connector 10 and the second electronic system such that the second electronic system may be mounted to the right angle connector 10 in a more secure manner, thereby reducing or even eliminating the risk that the electrical connection between the right angle connector 10 and the second electronic system, such as the electrical connection between the contact portions 201 of the terminals 200 of the right angle connector 10 and the conductive portions of the second circuit board, is broken due to the movement of the second circuit board away from its mounting position.

The shell 300 may further include a locking assembly 400 configured for locking and unlocking the second electronic system connected to the right angle connector 10 through the socket 113. In other words, the locking assembly 400 is configured for locking the second electronic system to the right angle connector 10. In some examples, the locking assembly 400 may be configured for being movably mounted to the shell 300. As shown in FIGS. 1A to 1G, the locking assembly 400 may include a pivot 401 configured for being mountable to the shell 300 and a locking member 407 pivotally mounted to the pivot 401 and capable of pivoting in a first direction 403 (FIG. 1F) and in a second direction 404 (FIG. 8C) opposite to the first direction 403.

Figure 5B:
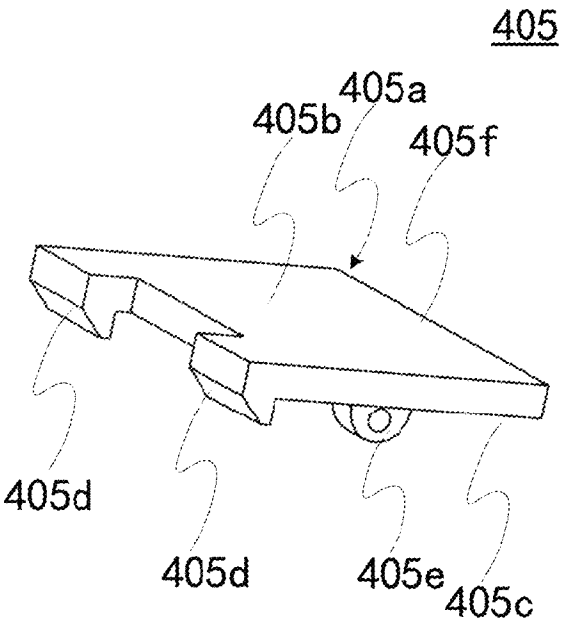
FIG. 5B is another perspective view of the locking member shown in FIG. 5A.
Figure 5A:
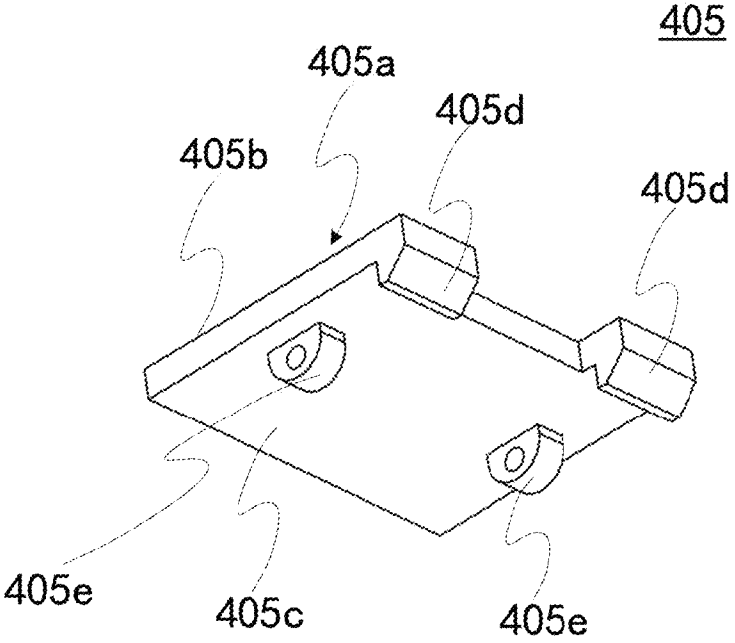
FIG. 5A is a perspective view of a locking member of a locking assembly of the shell of the electrical connector assembly shown in FIG. 1A.

With continuing reference to FIGS. 5A and 5B, FIGS. 5A and 5B illustrate the locking member 405 of the locking assembly 400 in detail. The locking member 405 may include a body 405*a* in the form of a pivot plate. The body 405*a* may include a top face 405*b* and a bottom face 405*c* opposite to the top face 405*b*. The locking member 405 may further include a locking portion extending from the body 405*a*. In some examples, the locking portion may be in the form of a barb 405*d*, which may extend from an end of the body 405*a* and protrude from the bottom face 405*c*. The bottom face 405*c* may be formed with a mounting portion 405*e* configured for allowing the locking member 405 to be pivotally mounted to the pivot 401.

Turning back to FIGS. 1A to 1G, the locking assembly 400 may further include a bias member 407, which may be arranged to act on the locking member 405 such that the locking member 405 tends to pivot towards a locked position in the first direction 403. As shown in FIGS. 1C to 1F, the locking member 405 pivots in the first direction 403 under the action of the bias member 407 until the locking portion abuts against the shell 300. The body 405*a* of the locking member 405 may further include an actuation portion 405*f*, such as the end of the body 405 opposite to the barb 405*d* as illustrated in the drawings. The actuation portion 405*f* may be configured to cause the locking member 405, when actuated (e.g., depressed), to pivot towards a released position (FIG. 8C) in the second direction 404 opposite to the first direction 403 against the action of the bias member 407. In some examples, the bias member 407 is a torsion spring that is disposed around the pivot 401, with an end thereof attached to the locking member 405 and the other end thereof attached to the pivot 401 or the shell 300.

With continuing reference to FIGS. 3A to 3E, the shell 300 may further include a groove 321 configured for disposing the locking assembly 400. In some examples, the groove 321 may be formed in the body 301 of the shell 300 and extend into the slot. This allows the locking member 405 to pivot into the slot. For example, when the slot is interfaced with the corresponding positioning mechanism of the second electronic system, the locking portion may pivot into the slot with the locking member 405 and be latched to the corresponding locking mechanism of the second electronic system, thereby locking the second electronic system in place and preventing the second electronic system from moving out from the socket 113 of the right angle connector 10. This improves the reliability of the connection between the right angle connector 10 and the second electronic system, allowing the second electronic system to be mounted to the right angle connector 10 in a more secure manner, thereby reducing or even eliminating the risk that the electrical connection between the right angle connector 10 and the second electronic system is broken due to the movement of the second electronic system away from its mounting position. In some examples, as shown in FIG. 3A, in the case where the body 301 includes the outer shell 301*a* and the inner shell 301*b* separated by the slot, the groove 321 may separate the outer shell 301*a* into a first L-shaped section and a second straight section. In some examples, the groove 321 extends into the slot and separates the slot into the first section 319*a* and the second section 319*b*. It should be appreciated that the corresponding locking mechanism of the second electronic system may be a dimple formed in the housing of the second electronic system or any other suitable mechanism. Although the groove 321 is shown in FIGS. 3A to 3E to be recessed into the body 301 from the top face 303, it should be appreciated that the groove 321 may be recessed into the body 301 from other side faces, such as from the left side face 311 and from the right side face 313. In the case where the groove 321 is recessed into the body 301 from the top face 303, the body 405*a* of the locking member 405 in the form of a pivot plate may be mounted to the body 301 of the shell 300 parallel to the first circuit board 500 when the body 301 of the shell 300 is mounted onto the first circuit board 500. In the cases where the groove 321 is recessed into the body 301 from the left side face 311 or from the right side face 313, the body 405*a* of the locking member 405 in the form of the pivot plate may be mounted to the body 301 of the shell 300 perpendicular to the first circuit board 500 when the body 301 of the shell 300 is mounted onto the first circuit board 500. In addition, although only one locking assembly 400 is shown, it should be appreciated that the right angle connector 10 may include more than one locking assemblies. It should also be appreciated that the locking assembly 400 may be arranged in any other suitable manner.

Figure 1B:
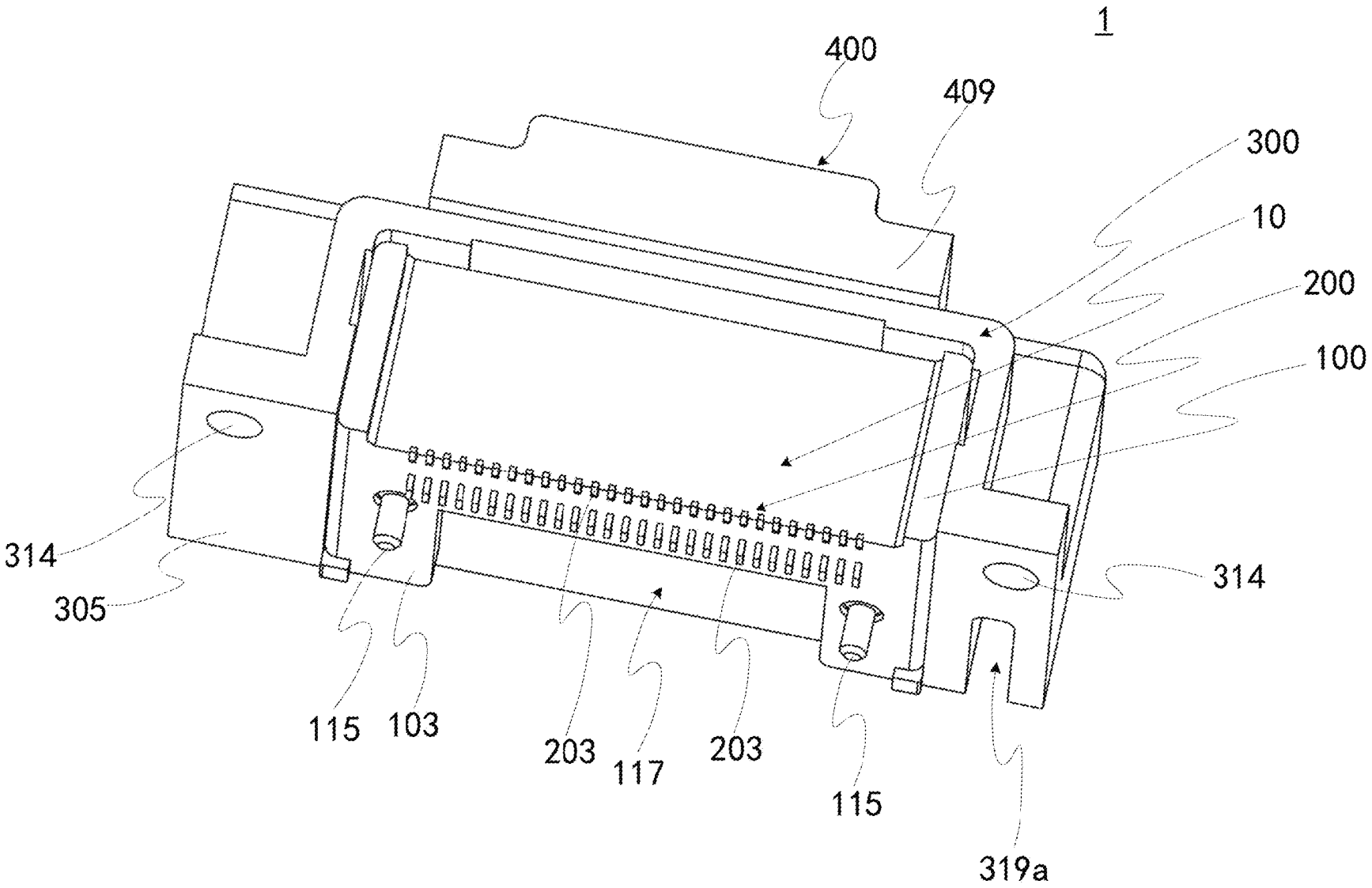
FIG. 1B is a rear, bottom perspective view of the electrical connector assembly shown in FIG. 1A, according to some embodiments.
Figure 1C:
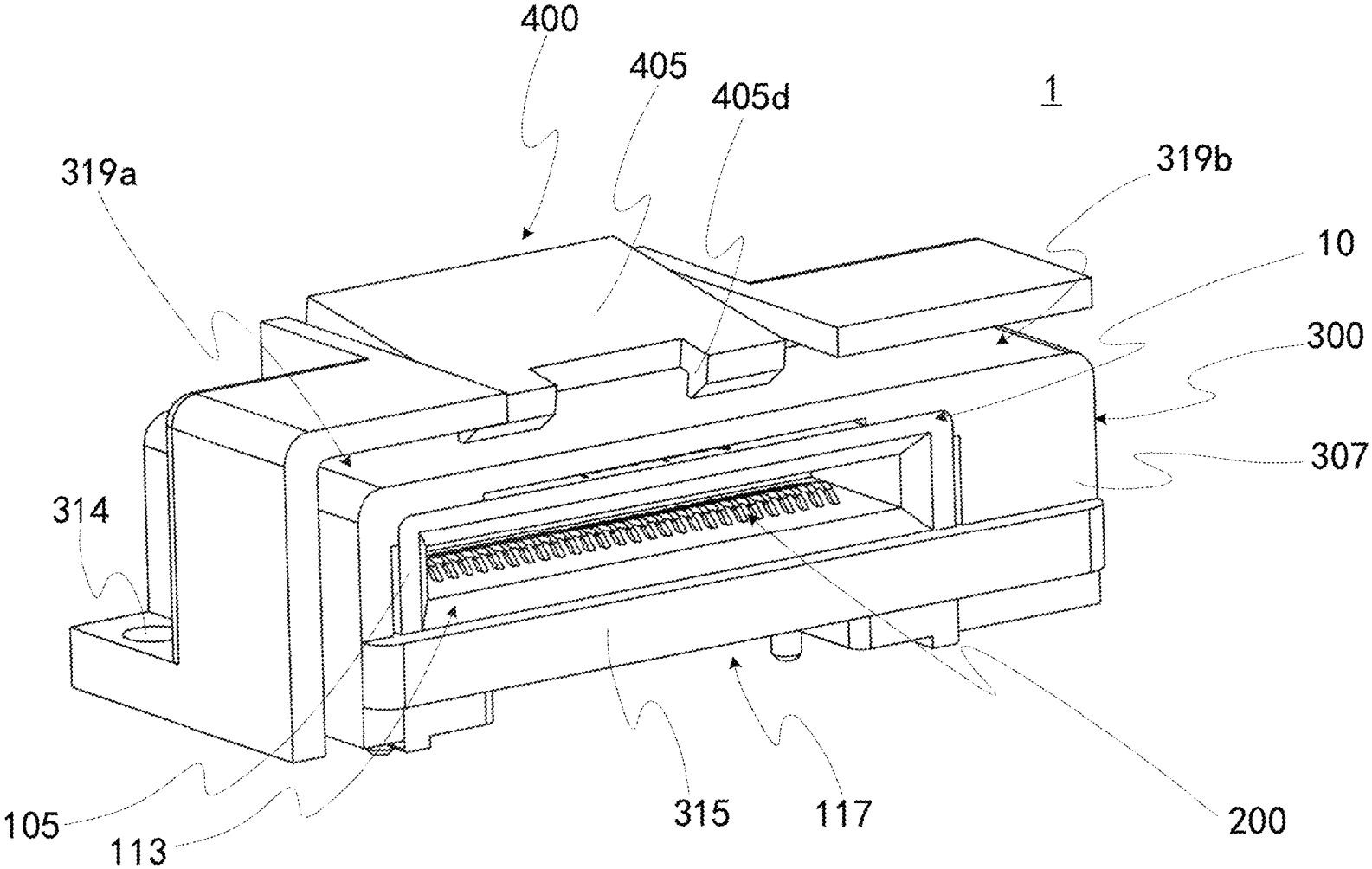
FIG. 1C is a another front, side perspective view of the electrical connector assembly shown in FIG. 1A, with a position assurance member of a locking assembly of a shell removed and a locking member in a locked position, according to some embodiments.
Figure 1D:
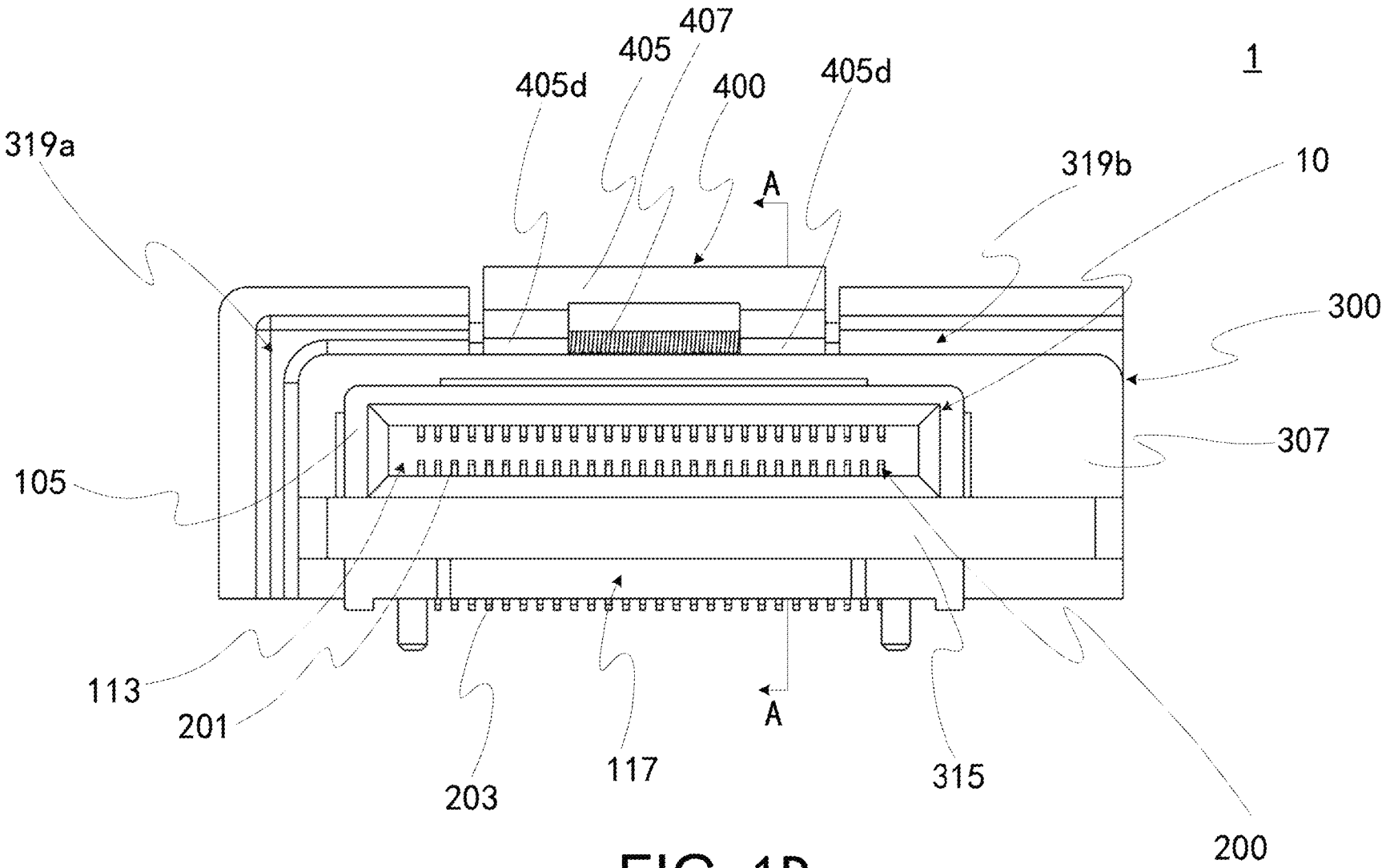
FIG. 1D is a front plan view of the electrical connector assembly shown in FIG. 1C, according to some embodiments.
Figure 1E:
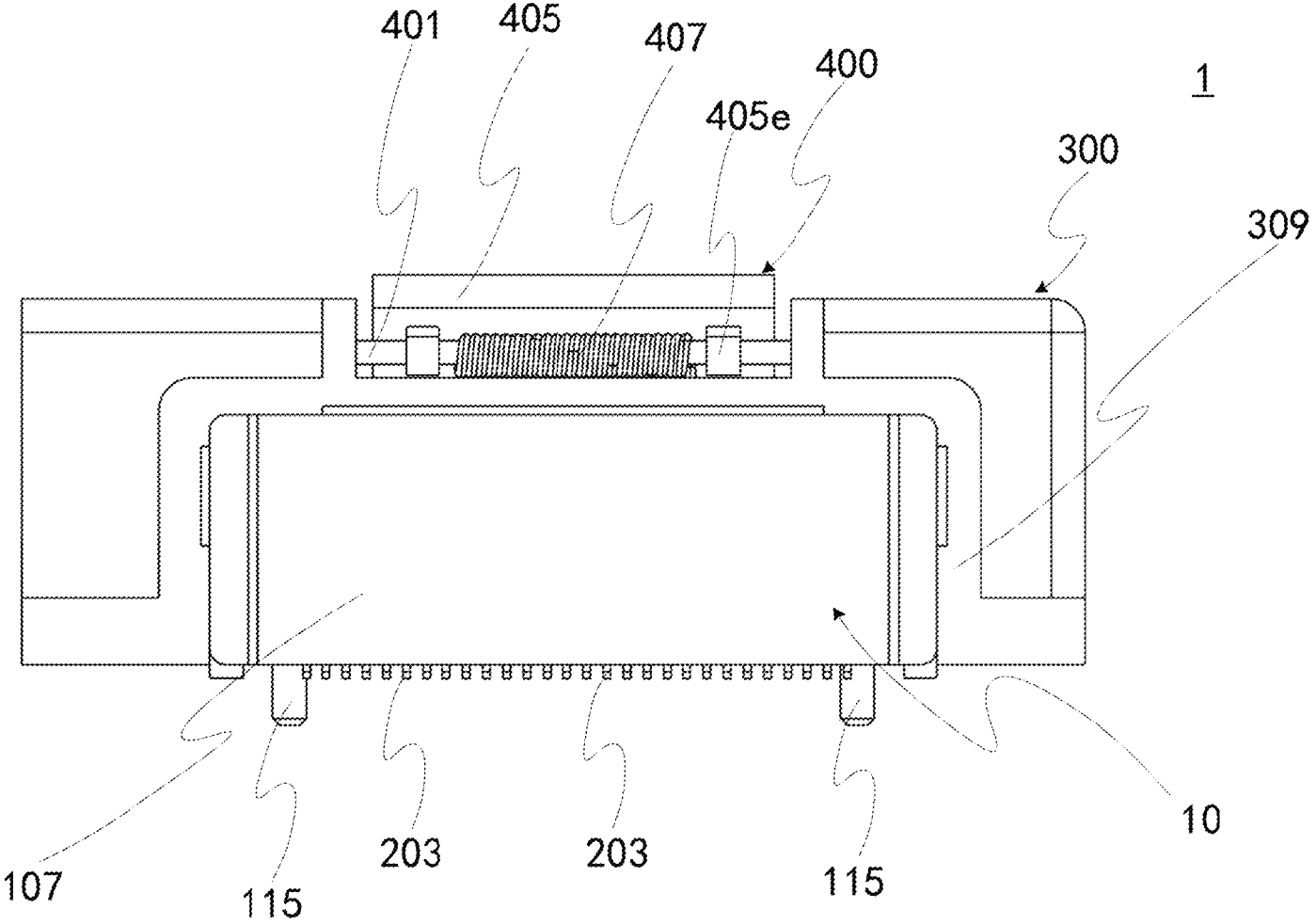
FIG. 1E is a rear plan view of the electrical connector assembly shown in FIG. 1C, according to some embodiments.
Figure 1F:
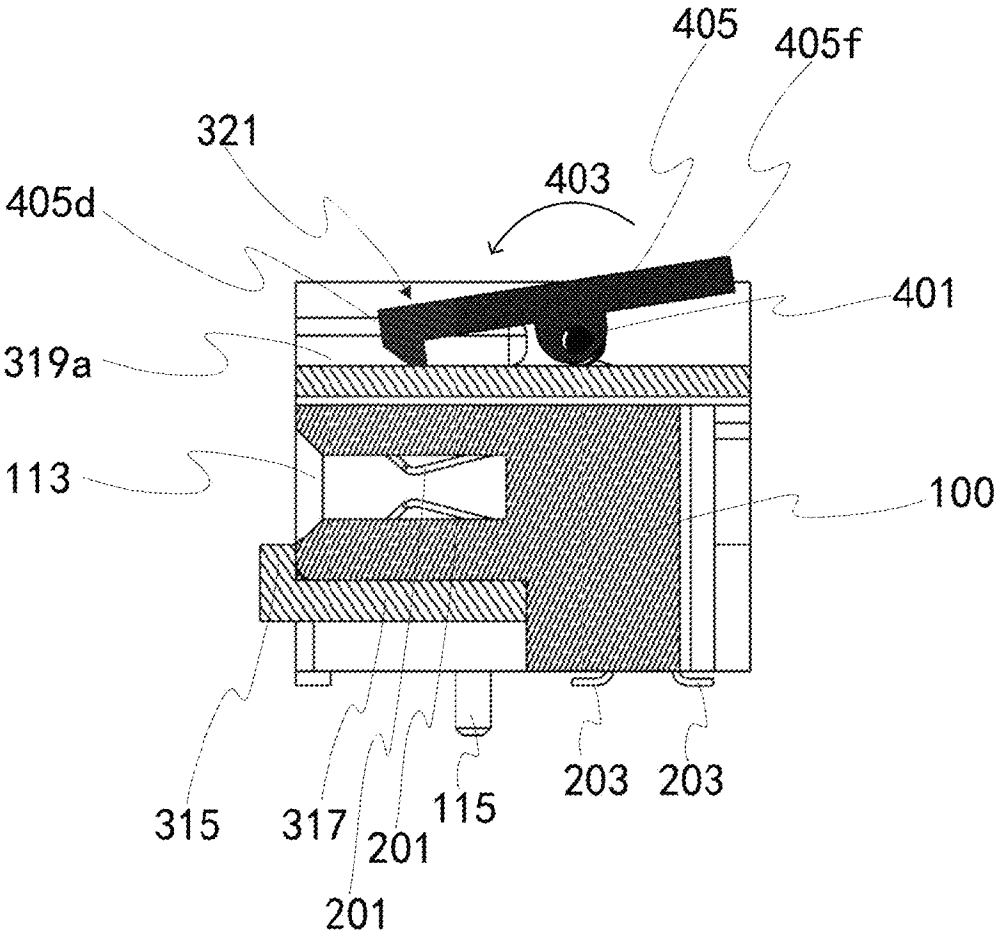
FIG. 1F is a cross-sectional view along line A-A in FIG. 1D, according to some embodiments.
Figure 1G:
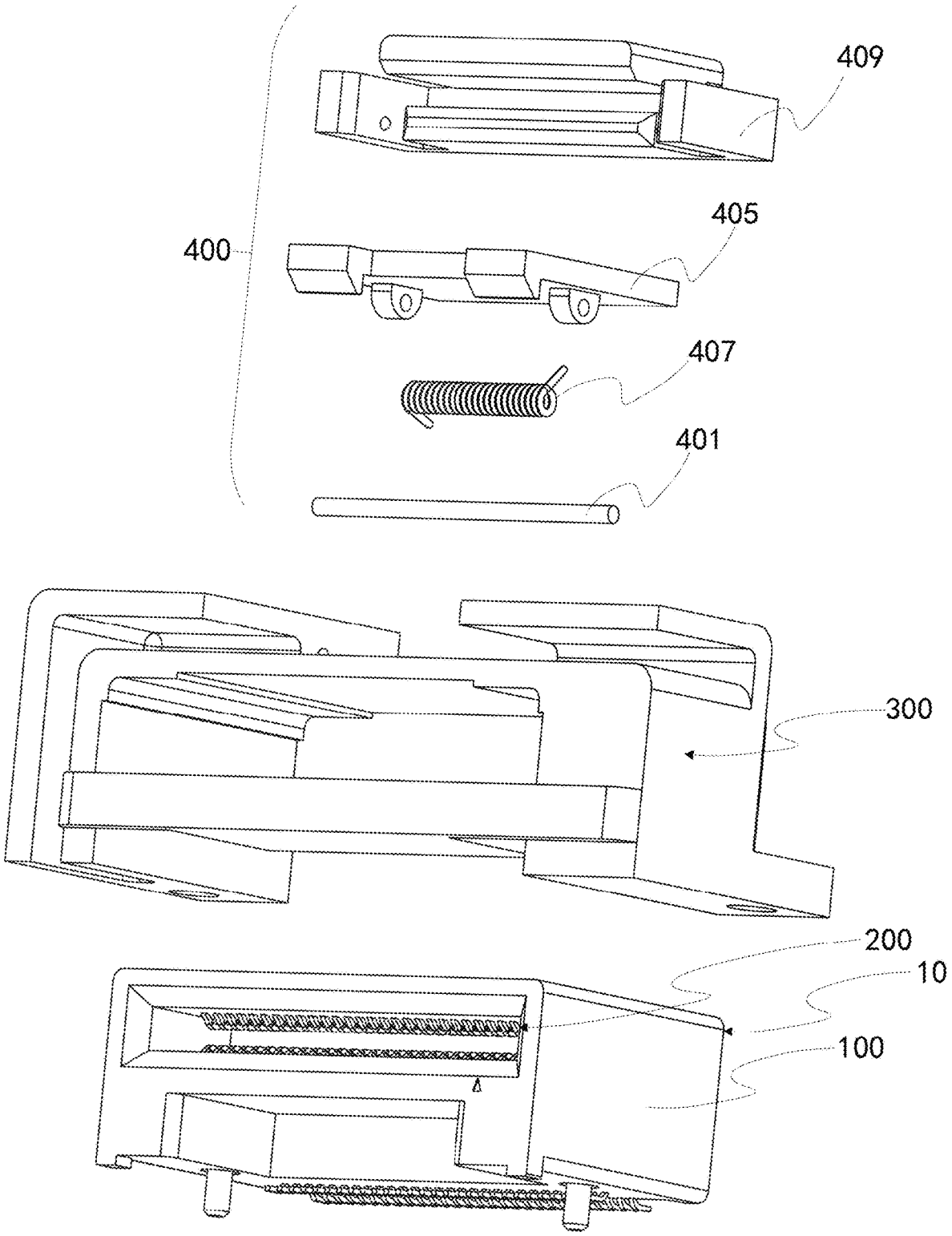
FIG. 1G is an exploded view of the electrical connector assembly shown in FIG. 1A.
Figure 6B:
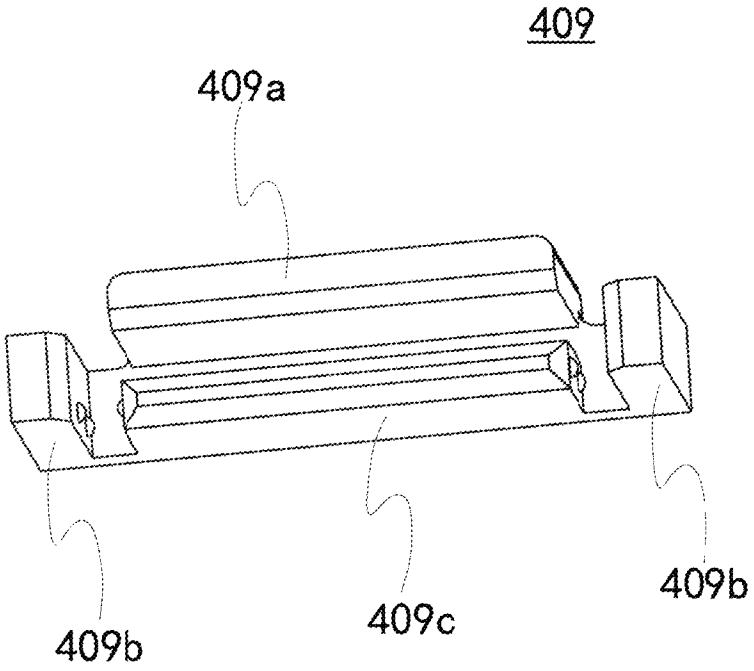
FIG. 6B is another perspective view of the position assurance member shown in FIG. 6A.
Figure 6A:
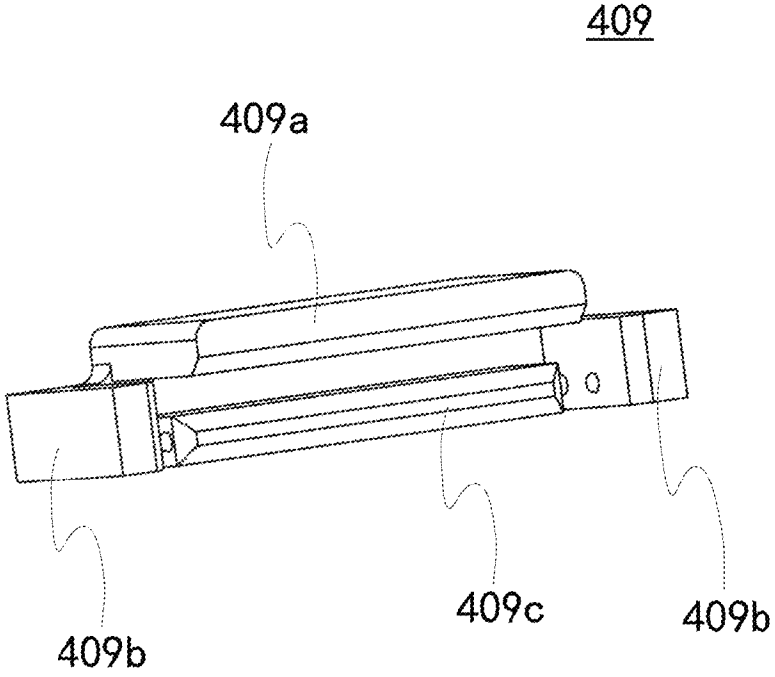
FIG. 6A is a perspective view of a position assurance member of the locking assembly of the electrical connector assembly shown in FIG. 1A.

As shown in FIG. 1A, FIG. 1B and FIG. 1G, the locking assembly 400 may further include a position assurance member 409 configured for retaining the locking member 405 in the locked position. With continuing reference to FIGS. 6A and 6B, FIGS. 6A and 6B illustrate the position assurance member 409 of the locking assembly 400 in detail.

The position assurance member 409 may include a first mounting portion 409*a* and a second mounting portion 409*b* extending from the body of the position assurance member 409, with the first mounting portion 409*a* configured for attaching to the locking member 405 and the second mounting portion 409*b* configured for attaching to the shell 300. The position assurance member 409 may further include a tongue 409*c* extending from the body of the position assurance member 409, the tongue 409*c* is configured to be inserted between the locking member 405 and the shell 300 when the locking member 405 is in the locked position, so as to block the locking member from pivoting towards the released position in the second direction 404 (FIG. 8C) opposite to the first direction 403, thereby retaining the locking member 405 in the locked position. This prevents the locking member 405 from accidentally moving away from the locked position, such that the locking assembly 400 may lock the second electronic system to the right angle connector 10 in a more reliable manner, thereby mounting the second electronic system to the right angle connector 10 in a more secure manner. Additionally, the position assurance member 409 may be further configured such that the position assurance member 409 cannot be inserted between the locking member 405 and the shell 300 when the locking member 405 is not in the locked position. This prevents the position assurance member 409 from being incorrectly inserted between the locking member 405 and the shell 300.

Figure 7A:
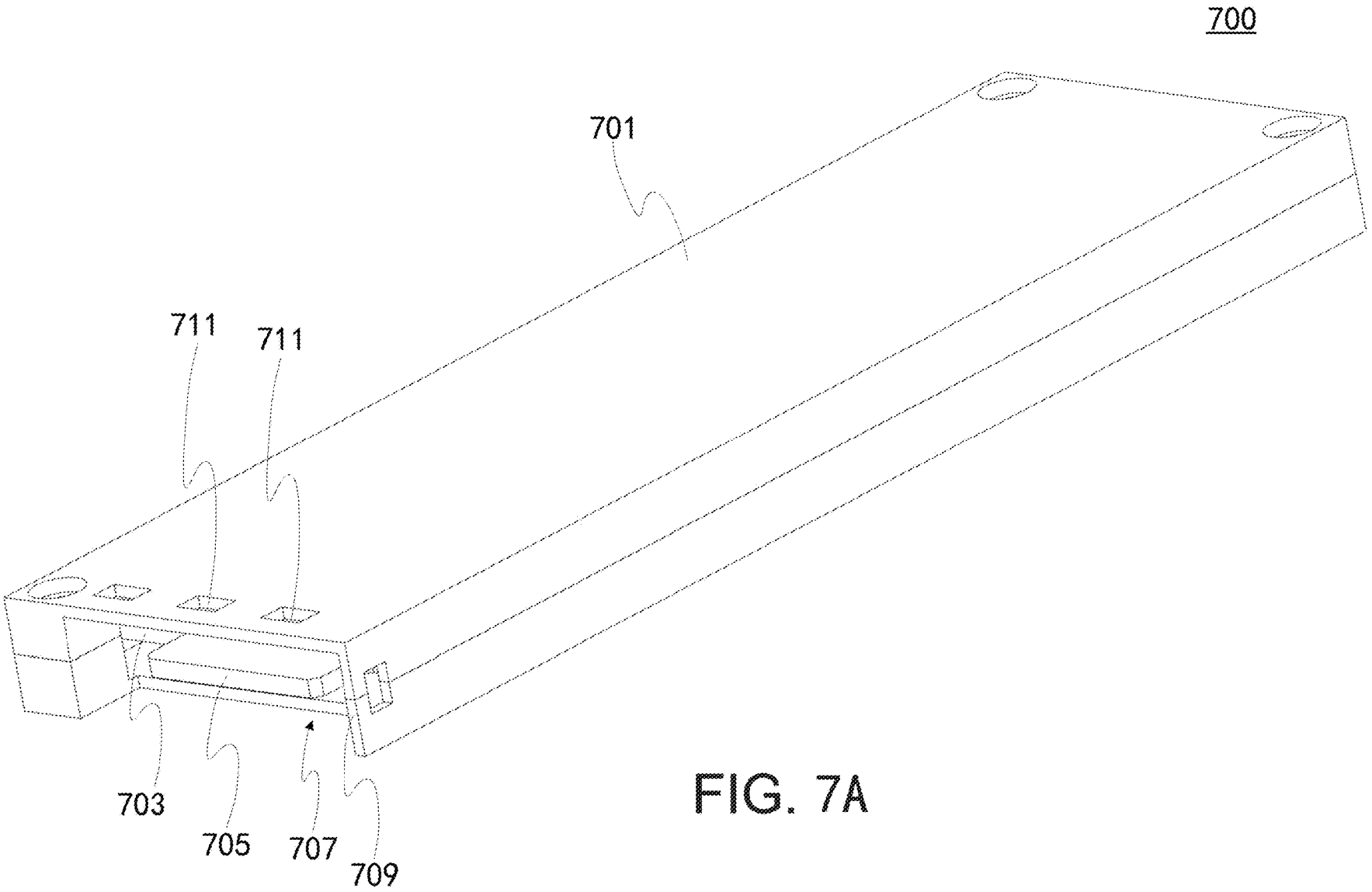
FIG. 7A is a perspective view of a second electronic system, such as an SSD, that may be connected to the electrical connector assembly shown in FIG. 1A, according to some embodiments
Figure 7B:
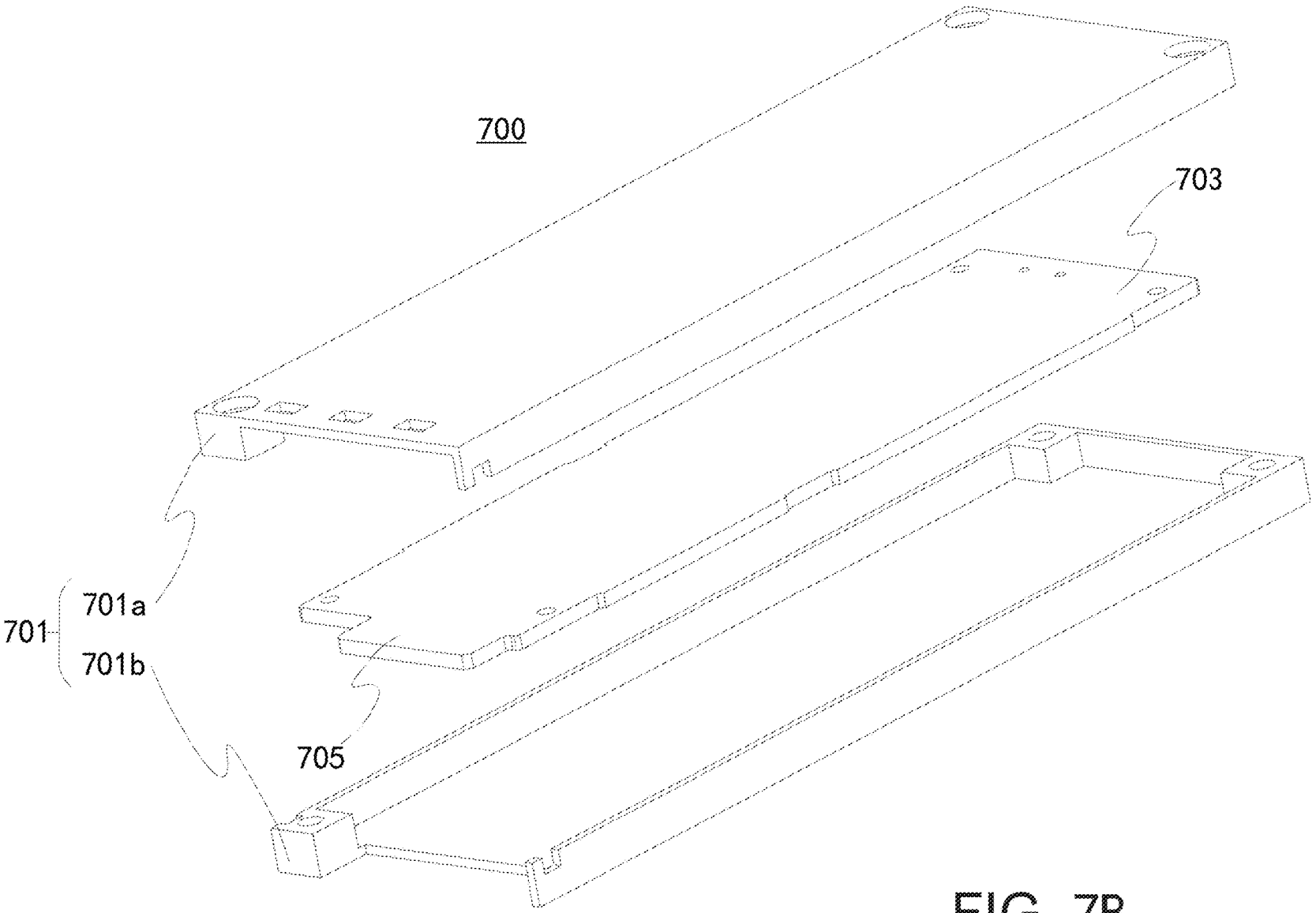
FIG. 7B is an exploded view of the second electronic system of FIG. 7A.

FIGS. 7A and 7B schematically illustrate a second electronic system 700 that may be used to be connected to the electrical connector assembly 1 according to a preferred embodiment of the present disclosure. The second electronic system 700 may be a storage device, such as a solid state drive (SSD). The second electronic system 700 may include a housing 701 and a second circuit board 703 disposed in the housing 701. Electronic components, such as a memory chip, may be mounted on the second circuit board 703. One end of the second circuit board 703 may be formed with a conductive portion 705 for contacting with the contact portions 201 of the terminals 200 of the right angle connector 10, thereby electrically connecting the second circuit board 703 to the terminals 200 of the right angle connector 10. The housing 701 may be formed with an opening 707 to expose the conductive portion 705 of the second circuit board 703. The portion of housing 701 around the conductive portion 705 may include a corresponding positioning mechanism configured for cooperating with the second positioning mechanism of the shell 300 of the electrical connector assembly 1. In some examples, the edge 709 of the housing 701 around the conductive portion 705 may be used as the corresponding positioning mechanism of the housing 701 and configured to be inserted into the slot of the shell 300 of the electrical connector assembly 1. The housing 701 may also be formed with a corresponding locking mechanism for cooperating with the locking member 405. In some examples, the corresponding locking mechanism of housing 701 may be a dimple 711 formed in the housing 701, and the barb 405*d* of the locking member 405 may be snapped into the dimple 711. Further, although the housing 701 is shown in FIGS. 7A and 7B as including two halves 701*a* and 701*b* configured to be joined together, it should be appreciated that the housing 701 may also be in the form of a whole piece or any other suitable form.

Figure 8A:
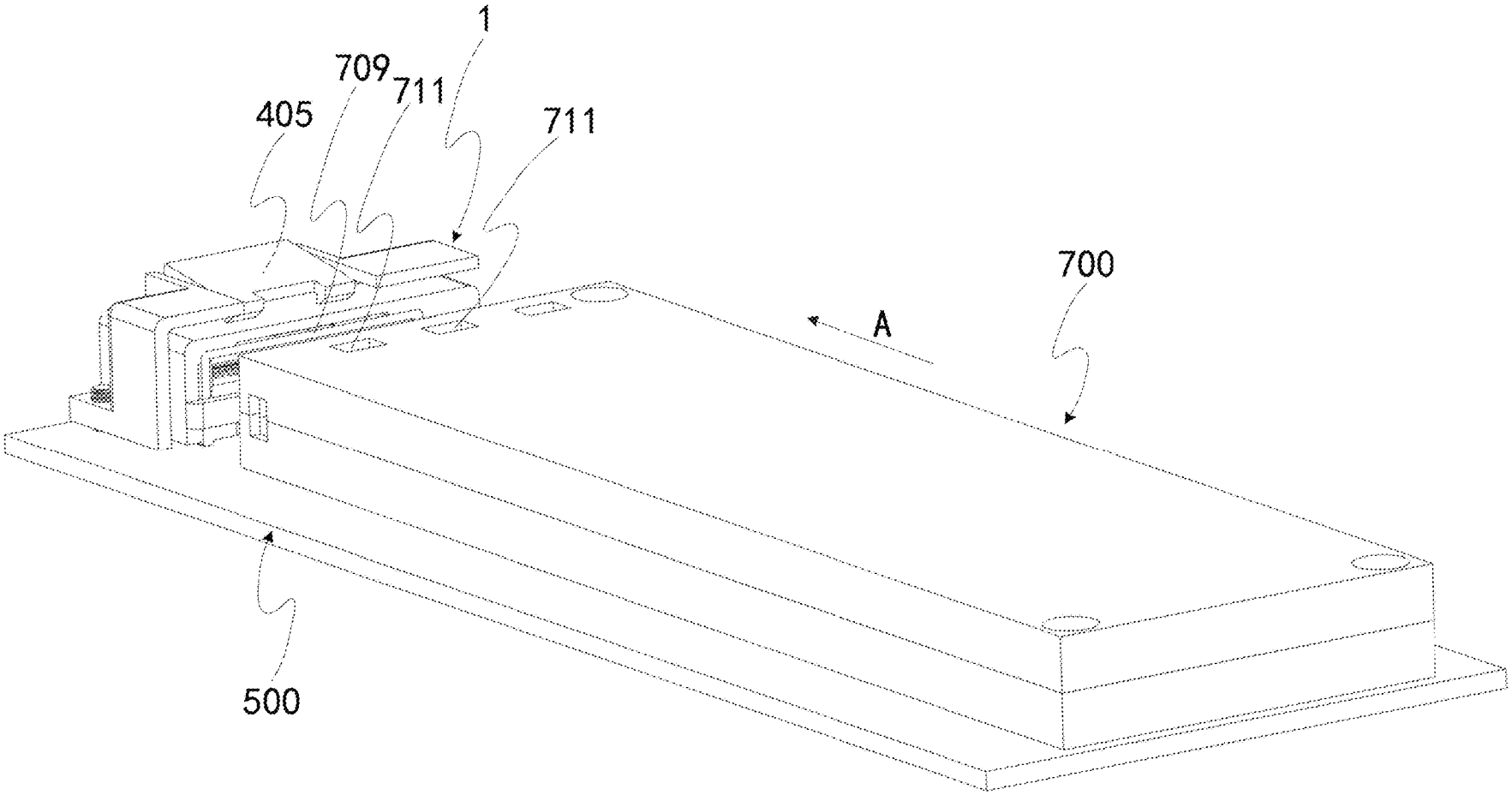
FIGS. 8A to 8E schematically illustrate the process of connecting the second electronic system shown in FIG. 7A with the electrical connector assembly shown in FIG. 1A, according to some embodiments.
Figure 8B:
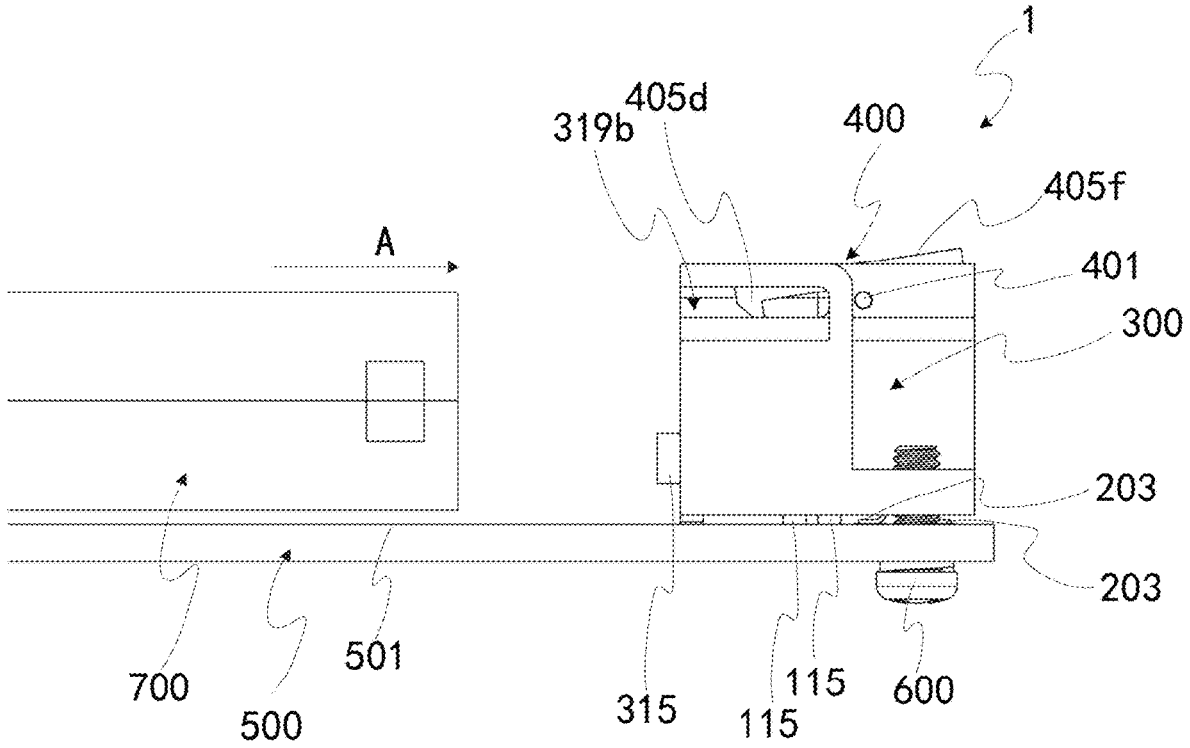
Figure 8C:
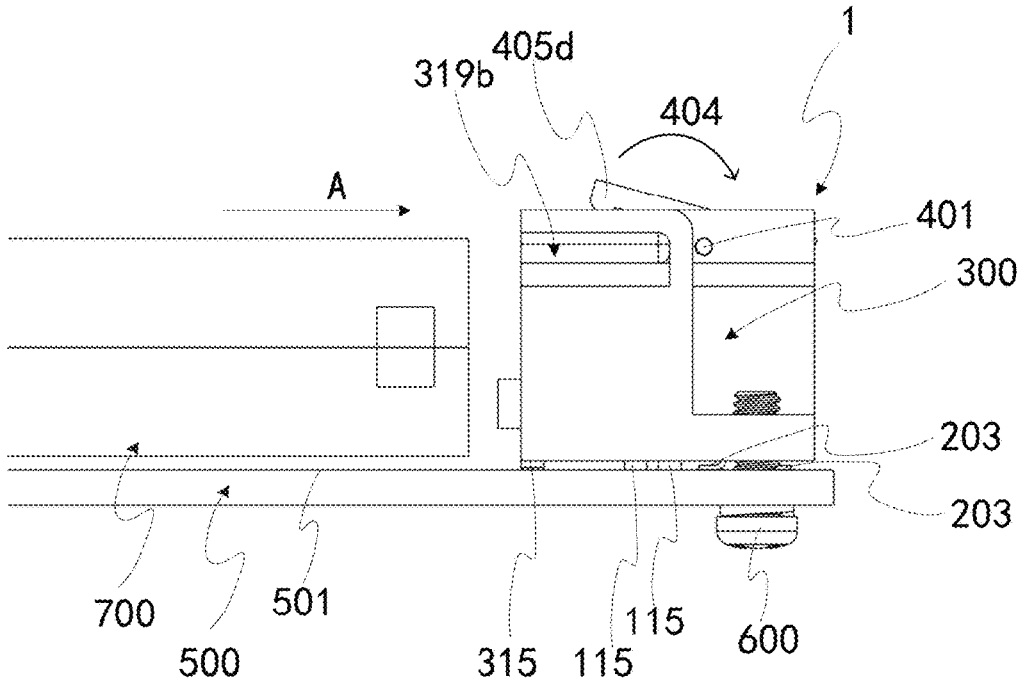
Figure 8D:
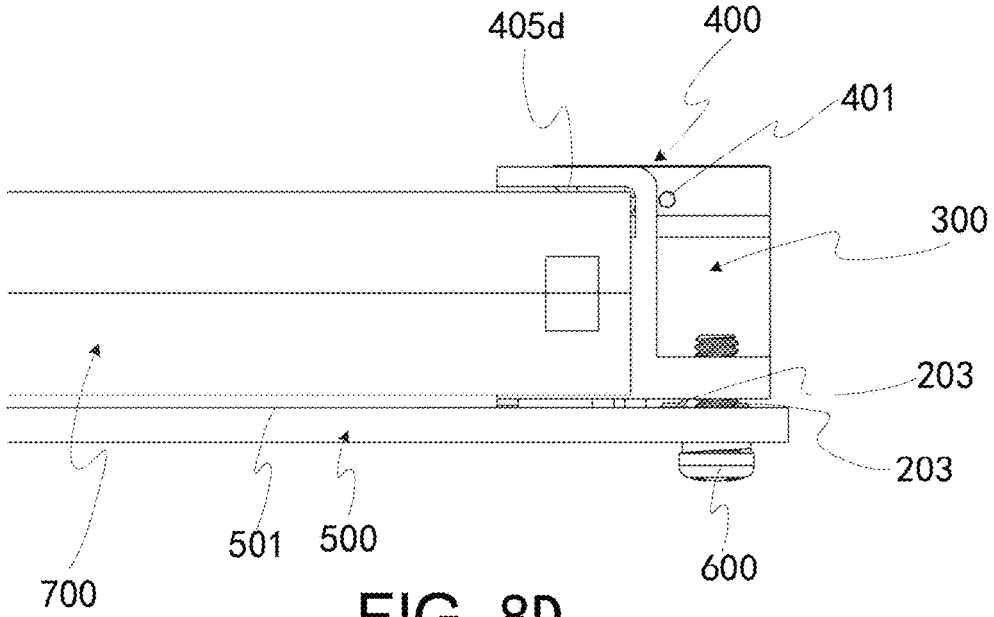
Figure 8E:
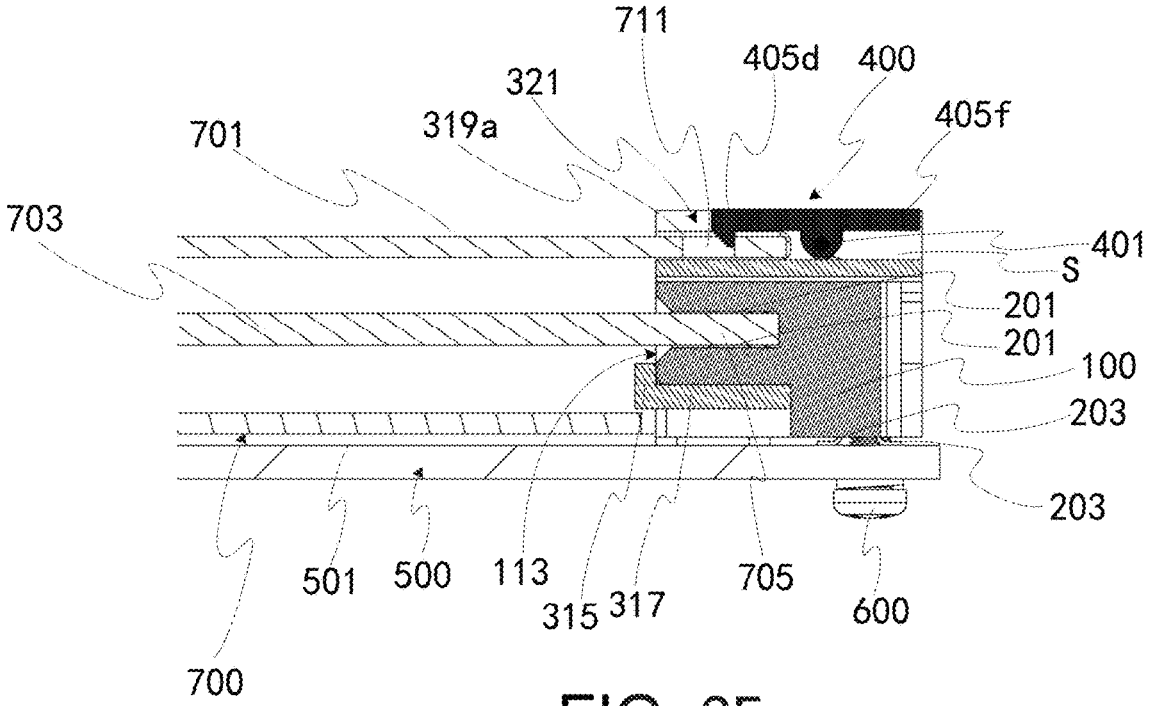

FIGS. 8A to 8E schematically illustrate the process of connecting the second electronic system 700 shown in FIG. 7A to the electrical connector assembly 1 shown in FIG. 1A. As shown in FIGS. 8A and 8B, the electrical connector assembly 1 has been fixed to the first electronic system, such as the first circuit board 500, in the manner as described above with respect to FIGS. 4A and 4B. The position assurance member 409 of the locking assembly 400 is removed to allow the locking member 405 to pivot to the released position in the second direction 404. The second electronic system 700 is moved towards the front side face 307 (i.e., the first interfacing face) of the right angle connector 10 in a direction indicated by an arrow A. As shown in FIG. 8C, the actuation portion 405*f* is actuated (e.g., depressed) such that the locking member 405 pivots to the released position in the second direction 404 opposite to the first direction 403 against the action of the bias member 407. The corresponding positioning mechanism of the second electronic system, such as the edge 709, is aligned with the second positioning mechanism of the shell 300. The second positioning mechanism of the shell 300 cooperates with the corresponding positioning mechanism of the second electronic system to ensure that the second electronic system is properly connected to the right angle connector 10. As shown in FIG. 8D and FIG. 8E, the second electronic system 700 is mounted in place. At this point, the second positioning mechanism of the shell 300 and the corresponding positioning mechanism of the second electronic system cooperate with each other to prevent the second electronic system from moving in the direction of the second interfacing face. The conductive portion 705 of the second electronic system 700 is inserted between the two terminal rows through the socket 113 in the front side face 105 (i.e., the first interfacing face) of the insulative housing 100, and the contact portions 201 of the corresponding terminals 200 are pressed against the conductive portion 705. Then, the actuation portion 405*f* may be released to allow the locking member 405 to pivot to the locked position in the first direction 403 under the action of the bias member 407, such that the locking portion is latched to the corresponding locking mechanism of the housing 701, for example, the barb 405*d* is snapped into the dimple 711 of the housing 701. In this way, the locking member 405 locks the second electronic system 700 in place. Then, the position assurance member 409 may be mounted to the locking assembly 400 such that the tongue 409*c* is inserted into a space S between the locking member 405 and the shell 300 to block the locking member 405 from pivoting towards the released position in the second direction 404, thereby retaining the locking member 405 in the locked position.

The body 301 of the shell 300 may have a thickness in the range of 1 mm to 10 mm, wherein the thickness of the body 301 refers to a vertical distance from the top face 303, the left side face 311 and/or the right side face 313 to the cavity 306 of the body 301. In some examples, the vertical distance from the top face 303 to the cavity 306 of the body 301 may be in the range of 1 mm to 10 mm. In some examples, the vertical distance from the left side face 311 and/or the right side face 313 to the cavity 306 of the body 301 may be in the range of 1 mm to 10 mm. In some examples, the body 301 may have a uniform or non-uniform thickness around the cavity 306. The relative small thickness of the body 301 of the shell 300 may reduce a footprint of the shell 300 on the first circuit board 500 and thus reduce that of the electrical connector assembly 1 on the first circuit board 500. It should be appreciated that the body 301 of the shell 300 may have any other suitable thickness.

The body 301 of the shell 300 may be made of a metallic or non-metallic material, preferably of a metal alloy, more preferably of a zinc alloy. The body 301 may be manufactured using any suitable process, for example the body 301 may be manufactured by molding or machining. In some embodiments, the body 301 may be manufactured using a die casting process. Manufacturing the body 301 using the die casting process may make the body 301 more suitable for providing mechanical support and mechanical positioning, and in the case where the shell 300 includes the outer shell 301*a* and the inner shell 301*b* separated by the slot, manufacturing the body 301 using the die casting process may allow the outer shell 301*a* and the inner shell 301*b* easier to be formed. It should be appreciated that the shell may also be a two-piece shell, i.e., the outer shell 301*a* and the inner shell 301*b* may be manufactured separately and then joined together.

Although the present disclosure is described in detail above in connection with the right angle connector 10, it should be appreciated that the present disclosure is also applicable to vertical connectors and other suitable types of electrical connectors. Unlike the right angle connector 10, in a vertical connector, a socket is formed in the top face of the insulative housing opposite to the bottom face (in other words, in a vertical connector, an interfacing face is provided opposite to a mounting face), and the terminals of the vertical connector are configured such that the contact portions of the terminals are accessible via the socket. The vertical connector may also be used to connect the second electronic system, such as an SSD, to a first electronic system, such as a mother board. In some examples, the vertical connector may be configured to be mounted to the first electronic system, such as a motherboard, such that the tail portions of the terminals of the vertical connector are electrically connected to the conductive portions (for example, conductive traces) of the first electronic system. The second electronic system, such as an SSD, may be inserted into the socket such that the conductive portions of the second electronic system are disposed in contact with the contact portions of the corresponding terminals. In this way, the conductive portion of the second electronic system may be electrically connected to the corresponding conductive portion of the first electronic system via the terminals of the vertical connector, thereby establishing an electrical connection between the second electronic system and the first electronic system. The first electronic system and the second electronic system may communicate with each other by transmitting signals using the vertical connector using a standardized protocol, such as a PCI protocol.

It should also be appreciated that the terms "first", "second" and "third" are only used to distinguish an element or component from another element or component, and that these elements and/or components should not be limited by the terms.

The present disclosure has been described in detail in conjunction with specific embodiments. Obviously, the above description and the embodiments shown in the appended drawings should be understood to be exemplary and do not constitute a limitation on the present disclosure. For a person skilled in the art, various variations or modifications falling within the scope of the present disclosure can be made without departing from the spirit of the present disclosure.

What is claimed is:

1. A shell for an electrical connector, the electrical connector comprising an insulative housing and a plurality of terminals disposed in the insulative housing, each of the plurality of terminals comprising a contact portion and a tail portion, the tail portion protruding from a first mounting face of the insulative housing and configured for mounting to a first circuit board, the shell comprising:

a fixing mechanism configured for being fixed to the first circuit board;

a body configured to at least partially surround the insulative housing;

a cavity configured to receive the insulative housing; and a gap configured to receive an edge of a second electronic system mated to the electrical connector.

2. The shell of claim 1, comprising:

a locking assembly movably mounted to the body.

3. The shell of claim 2, wherein the locking assembly is configured for locking the second electronic system mounted to the electrical connector in place.

4. The shell of claim 3, wherein the locking assembly comprises:

a pivot mounted to the body;

a locking member pivotally mounted to the pivot and configured to pivot about the pivot in a first direction and a second direction opposite to the first direction; and a bias member arranged to act on the locking member such that the locking member tends to pivot towards a locked position in the first direction.

5. The shell of claim 4, wherein the locking member comprises an actuation portion, the actuation portion, when actuated, causes the locking member to pivot towards a released position in the second direction against the action of the bias member.

6. The shell of claim 4, wherein:

the bias member is a torsion spring, and the torsion spring is disposed around the pivot.

7. An electrical connector, comprising:

an insulative housing comprising a first interfacing surface having a socket;

a plurality of terminals supported by the insulative housing, each of the plurality of terminals comprising a contact portion and a tail portion, the tail portion protruding from a first mounting face of the insulative housing and configured for mounting to a first circuit board; and a shell comprising:

a body at least partially surrounding the insulative housing, the body comprising a second interfacing face configured to expose the socket of the first interfacing surface of the insulative housing, the second interfacing face comprising a support mechanism configured to support the first interfacing face of the insulative housing, and a locking assembly movably mounted to the body.

8. The connector of claim 7, wherein the locking assembly comprises:

a rod attached to the shell;

a member comprising a latching feature; and a spring mounted around the rod and configured to bias the member to rotate about an axis of rotation such that the latching feature is biased into a latching position.

9. The connector of claim 8, wherein the member of the locking assembly comprises a pivot plate and the latching feature extends from the pivot plate.

10. The connector of claim 8, wherein:

the locking assembly is configured to engage an edge of an electronic component, thereby holding the electronic component in a mated position with respect to the connector.

11. The connector of claim 10, wherein:

the tails are configured for surface mount to the first printed circuit board; and the shell is configured to be fastened to the first printed circuit board with fasteners.

12. The connector of claim 11, wherein:

the shell comprises a cavity and a gap, the insulative housing is at least partially disposed within the cavity, and the gap is configured to receive the edge of the electronic component.

13. The connector of claim 12, wherein the support mechanism is a cross bar spanning the width of the cavity.

14. An electrical connector, comprising:

an insulative housing;

a plurality of terminals supported by the insulative housing, each of the plurality of terminals comprising a contact portion and a tail portion, the tail portion protruding from a first mounting face of the insulative housing and configured for mounting to a first circuit board;

a shell comprising:

a body at least partially surrounding the insulative housing, and a latching mechanism movably mounted to the body; and a position assurance device configured to:

(a) fit between the latching mechanism and the shell when the latching mechanism is in a latched position;

(b) block movement of the latching mechanism when fully inserted between the latching mechanism and the shell; and (c) abut the latching mechanism when the latching mechanism is out of the latched position so as to interfere with insertion of the position assurance device between the latching mechanism and the shell when the latching mechanism is out of the latched position.

15. The connector of claim 7, wherein:

the insulative housing comprises a recess, and the shell further comprises a platform extending from the support mechanism into the recess.

16. A connector, comprising:

an insulative housing;

a plurality of terminals supported by the insulative housing, wherein the terminals comprise tails configured for connection to a printed circuit board; and a shell at least partially surrounding the insulative housing, wherein:

the shell comprises an outer shell and an inner shell separated by a channel, and the outer shell comprises a first segment, and a second segment separated from the first segment by a gap.

17. The connector of claim 16, wherein:

the first segment of the outer shell is L-shaped.

18. The connector of claim 17, wherein:

the second segment is straight.

19. The connector of claim 16, further comprising:

a latching mechanism disposed within the gap.

20. The connector of claim 19, wherein the latching mechanism comprises:

a rod having a first end coupled to the first segment and a second end coupled to the second segment, wherein the rod is elongated in a direction defining an axis of rotation; and a member comprising a latching feature mounted on the rod so as to rotate about the axis of rotation.

* * * * *